US008763262B2

(12) United States Patent
Smith-Habelow et al.

(10) Patent No.: US 8,763,262 B2
(45) **Date of Patent: *Jul. 1, 2014**

(54) SHAPE MEASURING TOOL

(75) Inventors: Susan C. Smith-Habelow, Montara, CA (US); Meghan Donnelly Hetke, Walnut Creek, CA (US); Eric Thompson, San Francisco, CA (US); Bill Smith, San Francisco, CA (US); Alexandra Levin, San Francisco, CA (US); Judy Guo, San Francisco, CA (US); Purin Phanichphant, Palo Alto, CA (US); Jesse Amos Silver, San Francisco, CA (US); Peter Riering-Czekalla, Oakland, CA (US); Gina Lynn Romero, Soquel, CA (US); Candice Patricia Tillitt, San Francisco, CA (US)

(73) Assignee: Levi Strauss & Co., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/270,952

(22) Filed: Oct. 11, 2011

(65) Prior Publication Data

US 2013/0019485 A1 Jan. 24, 2013

Related U.S. Application Data

(63) Continuation-in-part of application No. 12/917,887, filed on Nov. 2, 2010, now Pat. No. 8,307,560, and a continuation-in-part of application No. 29/376,345, filed on Oct. 5, 2010, now Pat. No. Des. 648,235, and a continuation-in-part of application No. 29/376,486, filed on Oct. 7, 2010, now Pat. No. Des. 662,429, and a continuation-in-part of application No. 29/376,488, filed on Oct. 7, 2010, now Pat. No. Des. 659,570.

(60) Provisional application No. 61/391,579, filed on Oct. 8, 2010.

(51) Int. Cl.

| | |
|---|---|
| ***A41H 3/00*** | (2006.01) |
| ***A41H 1/02*** | (2006.01) |
| ***G01B 3/02*** | (2006.01) |

(52) U.S. Cl.

USPC ..... 33/17 R; 33/756; 33/512

(58) Field of Classification Search

USPC ..... 33/17 R, 755, 756, 758, 759, 760, 2 R, 33/512

See application file for complete search history.

(56) References Cited

U.S. PATENT DOCUMENTS 167,957 A 9/1875 Ullrich
460,282 A * 9/1891 Smith ..... 33/2 R (Continued)

FOREIGN PATENT DOCUMENTS

JP 2009-249748 A 10/2009
JP 20090249748 A 10/2009

*Primary Examiner* — Christopher Fulton
(74) *Attorney, Agent, or Firm* — Aka Chan LLP

(57) ABSTRACT

A measuring tool is used to measure the shape of a person's body. The tool has a belt and at least one measuring tape attached, which extends perpendicularly to the belt. The tool is held to the person's waist with the belt. While the person is standing, shape measurements are typically made at one or more points based on the measuring tape. This measuring tape extends a length sufficient to include the person's seat and hip, where the shape will be measured, but will generally not be as long as the person's leg or long enough to touch the ground.

40 Claims, 45 Drawing Sheets

(56) References Cited

U.S. PATENT DOCUMENTS

| | | | | | |
|---|---|---|---|---|---|
| 519,090 | A | | 5/1894 | Newcomb | |
| 655,960 | A | | 8/1900 | Cunningham | |
| 736,052 | A | | 8/1903 | Adamson | |
| 900,568 | A | | 10/1908 | Miles | |
| 925,963 | A | | 6/1909 | Stoldt | |
| 942,338 | A | | 12/1909 | Morrison | |
| 988,683 | A | | 4/1911 | Wurtzel | |
| 1,096,975 | A | | 5/1914 | Watters | |
| 1,248,035 | A | | 11/1917 | Taylor | |
| 1,278,107 | A | | 9/1918 | Cherrie et al. | |
| 1,292,056 | A | | 7/1919 | Remy | |
| 1,784,888 | A | | 12/1930 | Couture | |
| 2,069,494 | A | * | 2/1937 | Hurst | 33/2 R |
| 2,205,626 | A | | 6/1940 | Mason | |
| 3,039,197 | A | | 6/1962 | Abbott | |
| 3,685,155 | A | * | 8/1972 | Oblander | 33/11 |
| D295,149 | S | | 4/1988 | Markin | |
| 4,868,990 | A | * | 9/1989 | Steinberg | 33/15 |
| 5,845,413 | A | * | 12/1998 | Zayat, Jr. | 33/760 |
| D533,094 | S | | 12/2006 | Sieber | |
| 7,685,727 | B2 | | 3/2010 | Sieber | |
| 7,698,832 | B2 | * | 4/2010 | Sacks | 33/755 |
| D648,235 | S | * | 11/2011 | Smith-Habelow | D10/71 |
| D659,570 | S | * | 5/2012 | Hetke et al. | D10/71 |
| D662,429 | S | * | 6/2012 | Hetke et al. | D10/71 |
| 8,307,560 | B2 | * | 11/2012 | Tulin | 33/17 R |
| 2006/0265892 | A1 | | 11/2006 | Sieber | |
| 2007/0209096 | A1 | | 9/2007 | Davis | |
| 2008/0104741 | A1 | | 5/2008 | Miller | |

* cited by examiner

SHAPE MEASURING TOOL

CROSS-REFERENCE TO RELATED APPLICATIONS

This patent application claims the benefit of U.S. provisional application 61/391,579, filed Oct. 8, 2010, and is a continuation-in-part of U.S. patent application Ser. No. 12/917,887, filed Nov. 2, 2010 now U.S. Pat. No. 8,307,560; Ser. No. 29/376,345, filed Oct. 5, 2010 now U.S. Design Pat. No. D648,235; Ser. No. 29/376,486, filed Oct. 7, 2010 now U.S. Design Pat. No. D662,429; and Ser. No. 29/376,488, filed Oct. 7, 2010 now U.S. Design Pat. No. D659,570, which are incorporated by reference along with all other references cited in this application.

BACKGROUND OF THE INVENTION

This invention relates generally to a shape measuring tool and kit and more specifically to a measuring tool to measure the curvature of a body in the seat and hip area for fitting a person into pants better, especially jeans and shorts.

In 1853, during the California Gold Rush, Levi Strauss, a 24-year-old German immigrant, left New York for San Francisco with a small supply of dry goods with the intention of opening a branch of his brother's New York dry goods business. Shortly after arriving in San Francisco, Mr. Strauss realized that the miners and prospectors (called the "forty niners") needed pants strong enough to last through the hard work conditions they endured. So, Mr. Strauss developed the now familiar jeans which he sold to the miners. The company he founded, Levi Strauss & Co., still sells jeans and is the most widely known jeans brand in the world. Levi's is a trademark of the Levi Strauss & Co.

Though jeans at the time of the Gold Rush were used as work clothes (which were relatively loose fitting since fashion was not a concern), jeans have evolved to be fashionably worn everyday by men and women, showing up on billboards, television commercials, and fashion runways. Fashion is one of the largest consumer industries in the U.S. and around the world. Jeans and related apparel are a significant segment of the industry.

As fashion, people want their jeans with a customized fit (e.g., "tight fitting jeans"). Good fitting jeans today have a form fit that is very different than, for example, the pants of the 1800s and early 1900s. Before, loose-fit or overly baggy pants and balloon dresses were the norm, since they were intended to hide or obscure the body shape. Today, modern technology has allowed the manufacture of off-the-shelf pants, jeans, and shorts having much better form fit, while at the same time being comfortable to wear.

Despite widespread success jeans have enjoyed, there is continuing desire to address the demands of the consumer even better. Consumers desire off-the-rack, form-fitting jeans for their own seat and hip shapes, without having to pay for custom tailoring. Existing jeans sizing systems, which may have addressed the market demand of the time they were developed, do not adequately address the demand of the modern consumer and their wide variety of body shapes.

It is challenging for consumers to find a pair of jeans that fit them, even if a consumer knows his or her pant size. Consumers shopping for clothes often are aware of this when trying on several pairs of pants, shorts, skirts, or shirts to find a comfortable and pleasing fit for them. Despite knowing their sizes, consumers may still need to try on several pairs of garments to get the "perfect" fit. Pants sizes come in different forms. For example, jean sizes can come in a number (e.g., 0, 1, 2, or higher) or may use a waist and inseam length measurement.

Further, different jeans have different leg openings such as boot cut, skinny, leggings, straight, skinny boot, or flare. There may be only one top block for each of these styles. A top block is a cut of the jean from the waistband through the hips and butt. Even if two people are the same size, they may not have the same proportions (e.g., waistband, hips, or butt measurements). For example, a person trying on a pair of pants may find that the waist fits, but the butt portion of the jeans do not, and another person may find that the waist does not fit, but the butt portion does.

There may be bunching or excess material in certain regions when the consumer tries on a pair of jeans. This may be because the jeans are too big or the inseam too long. There may also be pulling or creasing in certain regions when the consumer tries on a pair of jeans. This may be because the jeans are too tight. If the jeans are too tight, they will create a "muffin-top" and will not be flattering.

Consumers try on several pairs of pants, wasting time and perhaps not finding a pair worthy of purchasing. This makes it difficult for a person to find a nice fitting pair of pants. Knowing a consumer's shape will aid in the discovery of nice fitting garments. It would be beneficial to find a "perfect" fit for a consumer.

Therefore, there is a need for a shape measuring tool that assists the consumer in helping identify jeans having a proper fit.

BRIEF SUMMARY OF THE INVENTION

A measuring tool is used to measure the shape of a person's body. The tool has a belt and at least one measuring tape attached, which extends perpendicularly to the belt. The tool is held to the person's waist with the belt. While the person is standing, shape measurements are typically made at one or more points based on the measuring tape. This measuring tape extends a length sufficient to include the person's seat and hip, where the shape will be measured, but will generally not be as long as the person's leg or long enough to touch the ground.

In an implementation, the measuring tool has two measuring tapes attached to the belt. This allows more accurate leveling of another shape measuring tape, which is used to measure perpendicular to the belt-attached measuring tapes. For example, it may be desirable to make a girth measurement at 4 inches from the natural waist (where the belt is attached). By having two belt-attached measuring tapes on either side of the person, this allows one to align the shape measuring tape at the 4-inch markings on both belt-attached measuring tapes.

In a specific implementation, a measuring device includes a belt, two fastener loops, and two measuring tapes connected to the fasteners. The fastener loops wrap around the belt. A first measuring tape is connected to a first fastener loop, where the first fastener loop allows the first measuring tape to slide along the belt. A second measuring tape is connected to a second fastener loop, where the second loop allows the second measuring tape to slide along the belt.

In an implementation, the measuring device includes a first fastener that connects the first measuring tape to the first fastener loop. The first fastener loop has a first end connected to a first side of the first measuring tape by the first fastener, and a second end connected to a second side of the first measuring tape by the first fastener.

In another specific implementation, a measuring device includes a belt extending in a first direction, a flexible fabric panel having ruled markings, and a first hook connected to the panel. The fabric panel is connected to the belt. The ruled markings extend in a second direction, transverse to the first direction. The first hook is connected to the panel at a first distance from a reference point on the belt in the second direction, where the first hook points in the first direction.

In an implementation, the measuring device includes a second hook that connects to the panel at a second distance from the reference point on the belt in the second direction. The second hook points in the first direction. A first fastener punches through the flexible fabric panel and the belt and attaches the flexible fabric panel to the belt. A shape measuring tape includes an eye, connected to a side of the shape measuring tape, where the eye can removably connect to the first hook.

A specific implementation of a measuring tool kit includes a measuring device and a shape measuring tape. Another specific implementation of a measuring tool kit includes a measuring device, a shape measuring tape, and an indicator clip. The shape measuring tape includes an eye that can removably connect to the first hook. The measuring tool kit includes a leather strap that can hold the measuring device and measuring tape.

In a specific implementation, a method or technique of measuring a body shape for fitting jeans includes attaching a belt of a measuring tool to a person to be fitted, where the tool includes a flexible panel connected to the belt, with ruled markings extending in a direction perpendicular to the belt. After the belt is attached to the person, holding a shape measuring tape at a first distance from the belt using the ruled markings as a guide, extending the shape measuring tape around the person so the shape measuring tape is about parallel with the belt, and determining a first girth for the person at the first distance from a reference point on the belt using markings on the shape measuring tape.

In an implementation, the method includes holding a shape measuring tape at a second distance from the reference point on the belt using the ruled markings as a guide, extending the shape measuring tape around the person so the shape measuring tape is about parallel with the belt, and determining a jean fit category for the person using the markings on the shape measuring tape and the attached indicator.

In an implementation, determining a first girth for the person at the first distance from the belt includes attaching an indicator to a position on the shape measuring tape. The second distance is less than the first distance. In an implementation, determining an indicated jean fit category for the person includes reading the jean fit category which the attached indicator clip points to on the shape measuring tape.

In an implementation, the belt is a string. In another implementation, the belt has side-release belt buckle. A first end of a side-release belt buckle is connected to an end of the belt. A second end of the side-release belt buckle includes a loop through which the belt is fed through. A positioning of the second end on the belt is adjustable via the loop.

Embodiments of the invention can have measuring tapes with varying lengths. In an implementation, the first measuring tape has a length of about 12 inches or less. The second measuring tape has a length of about 12 inches or less. Further, measurement tapes and ruled markings can have different units of measure. In an implementation, the first measuring tape includes a first side showing measurements in United States customary units. The first measuring tape includes a second side showing measurements in the International System of Units. Ruled markings include United States customary units. Ruled markings include the International System of Units.

A distance of the hooks can vary. In an implementation, the first distance is about 4 inches. The second distance is about 8 inches. Further, in an implementation, the reference point is about ⅝ inch from a top side of the belt.

Other objects, features, and advantages of the present invention will become apparent upon consideration of the following detailed description and the accompanying drawings, in which like reference designations represent like features throughout the figures.

BRIEF DESCRIPTION OF THE DRAWINGS

FIG. 1A shows a specific implementation of the measuring tool, and FIG. 1B shows a specific implementation of the measuring tape.

FIG. 29A shows a specific implementation of the measuring tool. FIG. 29B shows a specific implementation of the measuring tape. FIG. 29C shows a specific implementation of the indicator clip.

FIG. 56A shows a specific implementation of the measuring tool. FIG. 56B shows a specific implementation of the shape measuring tape and string.

FIG. 57A shows a specific implementation of the bag. FIG. 57B shows a specific implementation of the shape measuring tool. FIG. 57C shows a specific implementation of the shape measuring tape. FIG. 57D shows a specific implementation of the user manual.

DETAILED DESCRIPTION OF THE INVENTION

People often have much difficulty finding the right pair of form-fitting jeans because people have different shapes. With a measuring tool of the invention, a person can make measurements to determine his or her shape. With this shape information (also known as Curve ID®), the person can choose a corresponding pair of jeans. Curve ID is a registered trademark of Levi Strauss & Co. Then, these jeans should be the right fit and the person does not have to go through a time-consuming process of trial and error, trying on numerous pairs of jeans. Not only for jeans, the measuring tool of the invention can be used to fit clothes for pants, trousers, shorts, and other apparel.

Figure 1A:
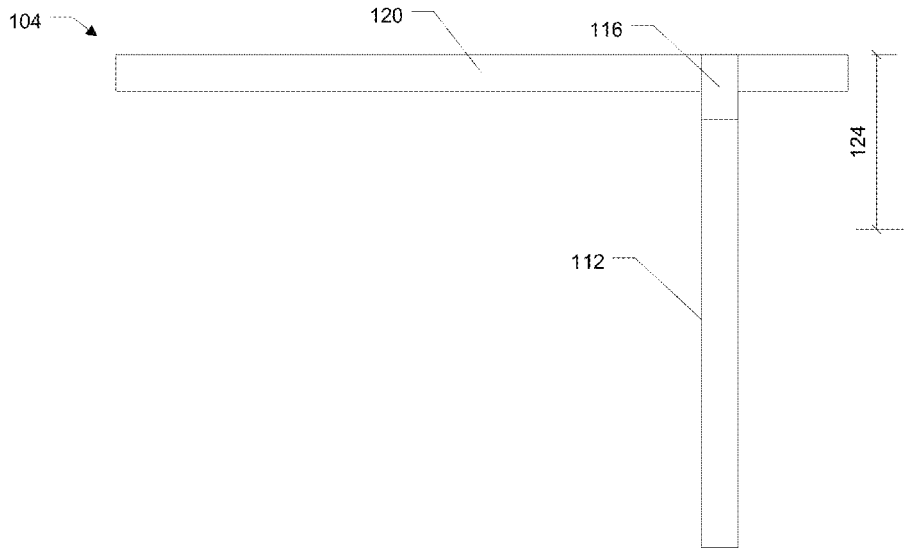
FIGS. 1A-1B show a specific implementation of a measuring tool kit having a measuring tool and a shape measuring tape.
Figure 1B:
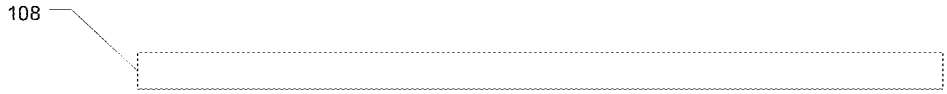

FIGS. 1A-1B show a specific implementation of a measuring tool kit. The measuring tool kit includes a measuring tool 104 and a shape measuring tape 108. FIG. 1A shows a specific implementation of the measuring tool, and FIG. 1B shows a specific implementation of the measuring tape. Measuring tool 104 has an attached measuring tape 112 which extends perpendicularly to belt 120. Belt-attached measuring tape 112 can sometimes be referred to as a measuring tape leaf. Tape 112 has ruled markings (not shown). Tape 112 is attached via a loop 116. This loop allows a person to slide tape 112 anywhere along a length of the belt, so it can be positioned as desired.

In an alternative implementation, belt-attached measuring tape 112 is attached with a fastener 116, rather than a loop. Then unlike the previous implementation, tape 112 will not be movable along the length of the belt.

In the kit, shape measuring tape 108 is a separate measuring tape that is not attached to the belt. Shape measuring tape 108 has ruled markings (not shown). Measuring tool 104 and shape measuring tape 108 are used together to make shape measurements. For example, at a distance 124 from the belt (e.g., indicated by a marking on tape 112), a measurer can use shape measuring tape 108 to measure a circumference or a girth of a person's body part.

The measuring tool in FIGS. 1A-1B is shown with one measuring tape 112 or leaf. However, in alternative implementations, the measuring tool can have two or more measuring tapes 112, both being attached to the belt. For example, in various implementations, the measuring tool has 3, 4, or more measuring leaves. As previously indicated, the measuring tool with two measuring leaves may be beneficial because a person can determine distance 124 at two sides of a person's body more easily. This allows a measurer to more easily keep shape measuring tape 108 level and at distance 124. Using a measuring tool having a single attached measuring tape, the user needs to be more careful to ensure the shape measuring tape is horizontal to make a precise measurement.

Figure 2:
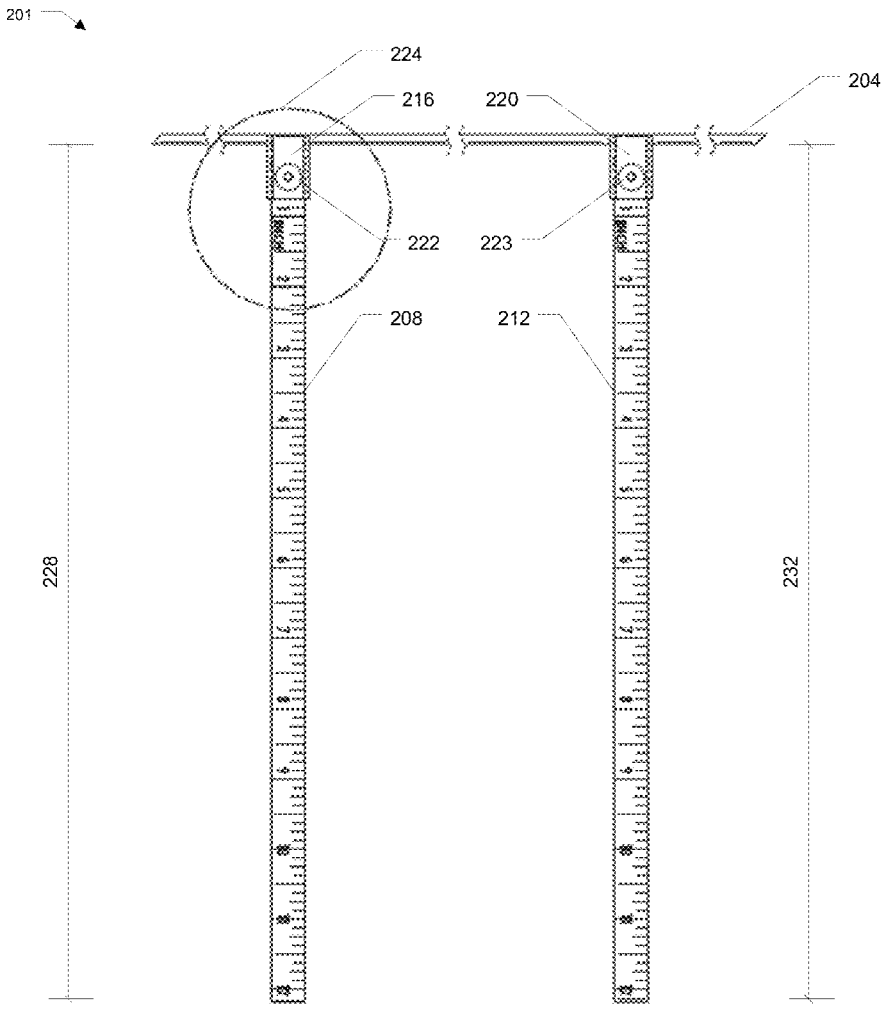
FIG. 2 shows a front view of a measuring tool having two belt-attached measuring tapes.

FIG. 2 shows a front view of a specific implementation of a measuring tool 201 having two measuring tapes or leaves. The measuring tool has a belt 204. Two measuring tapes 208 and 212 are attached to this belt via a first fastener loop or suspension loop 216 and a second fastener loop or suspension loop 220, respectively. The first fastener loop is attached to tape 208 using a fastener 222 (e.g., a rivet). The second fastener loop is attached to tape 212 using a fastener 223.

The belt is positioned in a first direction and is made of a flexible material that can bend and be wrapped around an object, typically a person's waist. The belt can be a string belt. To attach to a person, the string belt is cinched to a person's waist and then a bow knot tied. Also, ends of the belt can be fastened together using a belt buckle, side-release buckle, or other belt fasteners. The belt can have a variety of widths, such as ⅛, ¼, ½, ⅝, ¾, or 1 inch.

Fastener loops 216 and 220 wrap around the belt, and the fasteners go through ends of the loop and secure a tape (i.e., 208 and 212) between these ends.

When a person wears the belt and is standing, the measuring tapes will suspend from the belt, via the loops and fasteners. These measuring tapes will be in a second direction, substantially transverse to the first direction. The loops and fasteners suspend the measuring tapes below the belt and allow the measuring tapes to hang from the belt. An area in a circle 224 indicates the loop and fastener (see FIG. 5).

The first fastener loop allows the first measuring tape to slide along the belt, so it can be positioned where desired. Similarly, the second fastener loop allows the second measuring tape to slide along the belt.

Generally, a length 228 of the first measuring tape is sufficiently long to measure a person's shape in the waist, seat, and hip area. In a specific implementation, length 228 of the first measuring tape is about 12 inches. A length 232 of the second measuring tape is also 12 inches, which is the same as the first measuring tape. However, the lengths of both measuring tapes do not necessarily have to be the same. For example, in a specific implementation, length 228 of the first measuring tape is about 4 inches and a length 232 of the second measuring tape is about 8 inches.

In a specific implementation, a measurement for shape is made at about 8 inches from the natural waist. Then a measuring tape length of at least 8 inches (e.g., 9, 9.5, 10, or 11) will be sufficient to support such a measurement.

Lengths of the measuring tapes can be longer than 12 inches such as 13, 14, 15, or even longer. However, such lengths are unnecessary if the desired measurement is at most 8 inches from the waist. Further extremely long lengths, such as long as a person's leg or long enough to touch the floor are undesirable. If measuring tape 208 touches the floor, this may lead to a safety hazard, because the person being measured can trip over the tape. Also, longer tapes can be more easily snagged or pulled out of position, so the measurements would be less accurate.

Figure 3:
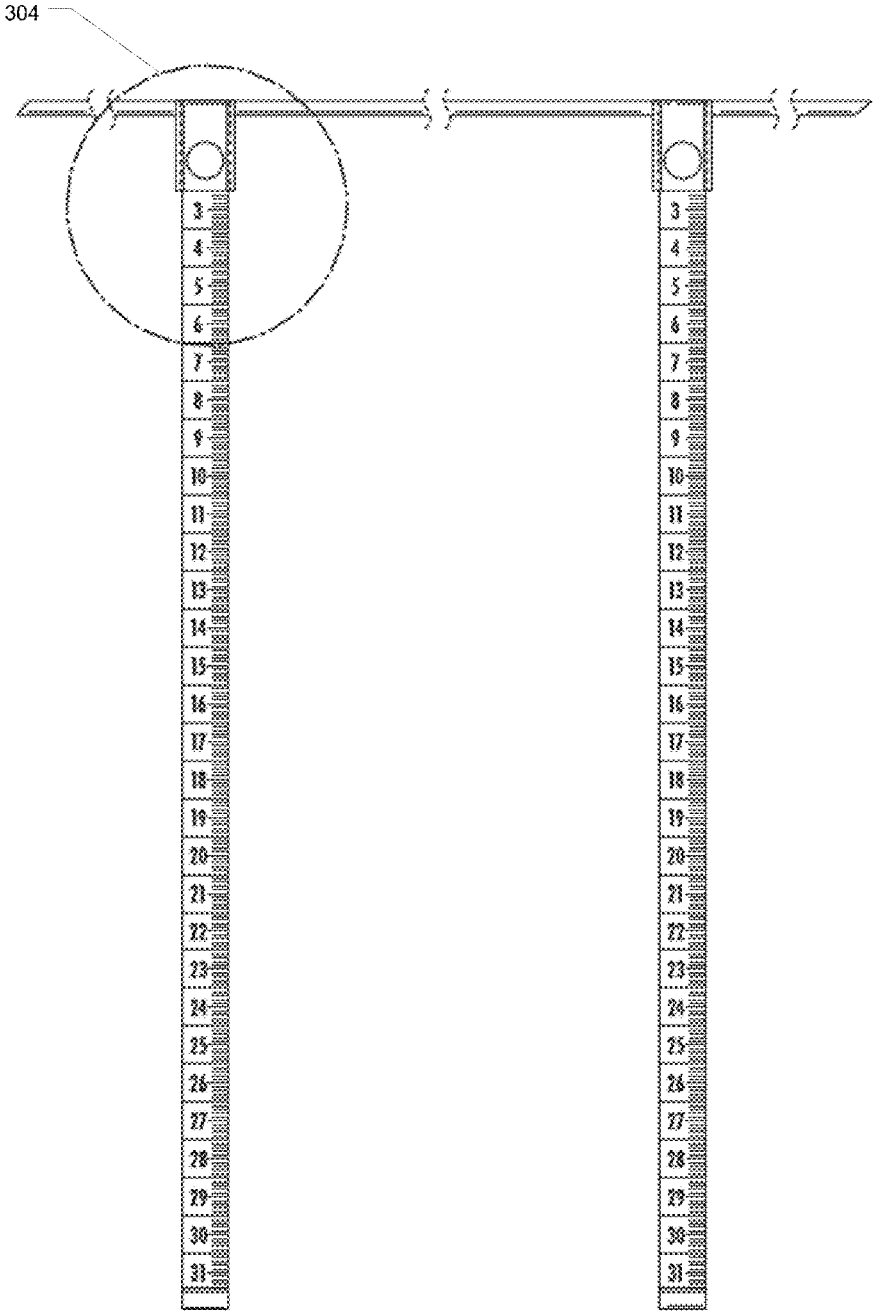
FIG. 3 shows a back view of the measuring tool having two measuring tapes.

FIG. 3 shows a back view of the measuring tool having two measuring tapes. An area in a circle 304 indicates the loop and fastener (see FIG. 6). In this implementation of FIGS. 1A, 1B and 3, a front or first side of a measuring tape measures according to inches, and a back or second side of the measuring tape measures according to centimeters. By providing both rules markings for both inches and centimeters, this tool can be used in places which use United States customary units (or English units) or the International System of Units (SI).

For example, in the U.S., the first side with inches will be used. In France, the second side with metric markings will be used. This allows one tool to be manufactured and used in different locations with different units of measures.

In alternative implementations, for a U.S. only tool, the measuring tapes may have United States customary units only (e.g., one side or both sides having inches). For other locations, the tool may be a metric only tool (e.g., one or both sides). The tape can be a single sided tool with ruled markings only on one side and blank or no ruled markings on the other side.

Other units of measure may be substituted for the United States customary units or the International System of Units, or both. Further, for metric, millimeters may also be shown on the measuring tap.

Figure 4:
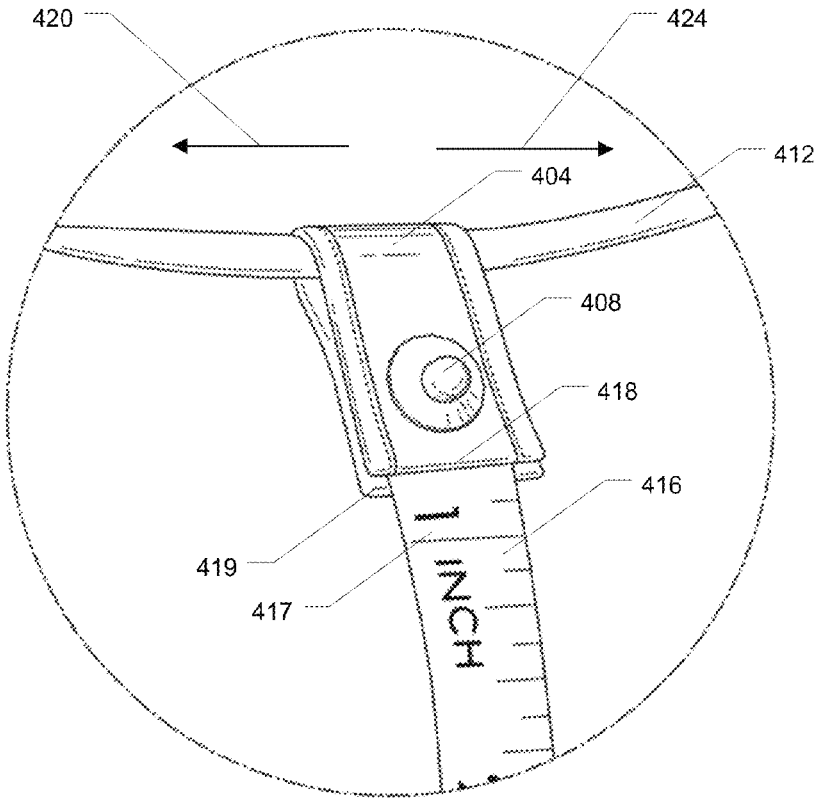
FIG. 4 shows a perspective view of a fastener loop and fastener.

FIG. 4 shows a perspective view of a fastener loop 404 and a fastener 408. In a specific implementation, fastener 408 is a rivet and burr. The fastener loop wraps or loops around a belt 412. The belt is in a first direction. The measuring tape is held by the loop and fastener in a direction substantially perpendicular to the belt.

A measuring tape 416 has a first side 417 and a second side (not shown). The fastener punches through two ends of the loop and also through the measuring tape. The fastener connects or joins the first side of the measuring tape to the fastener loop. The loop has a first end 418 connected to the first side of the measuring tape by the fastener, and a second end 419 connected to a second side of the measuring tape by the fastener. Between the first end and the second end of the loop is the measuring tape.

The fastener is arranged such that it allows the measuring tape to be suspended in a first or vertical direction. In another implementation, a hanger is used to suspend a measuring tape in a vertical direction.

In an implementation, the fastener loop and fastener are arranged such that measuring tape 416 can be moved along a first direction (e.g., left direction 420 or a right direction 424). The measuring tape or fastener can slide along the belt in either direction. To move the fastener or measuring tape to the left, a person can touch the measuring tape and pull or yank the measuring tape to the left. The person can also touch the fastener or fastener loop and pull or yank the fastener to the left. The person can do a combination of these movements to move the measuring tape and fastener. A similar approach can be implemented to move the fastener or measuring tape to the right.

In this implementation, a user can turn a measuring tool with two measuring tapes into a measuring tool with one measuring tape by sliding the loop off the belt. In this implementation, a user can also add another measuring tape to the measuring tool by sliding or adding a loop with an attached measuring tape to the belt.

In another implementation, the fastener is arranged such that it cannot slide along the belt. For example, in various implementations, the fastener is glued or stapled to a piece of the belt. In another implementation, the measuring tool does not include the fastener loop and fastener, and the measuring tape is directly attached to the belt.

Figure 5:
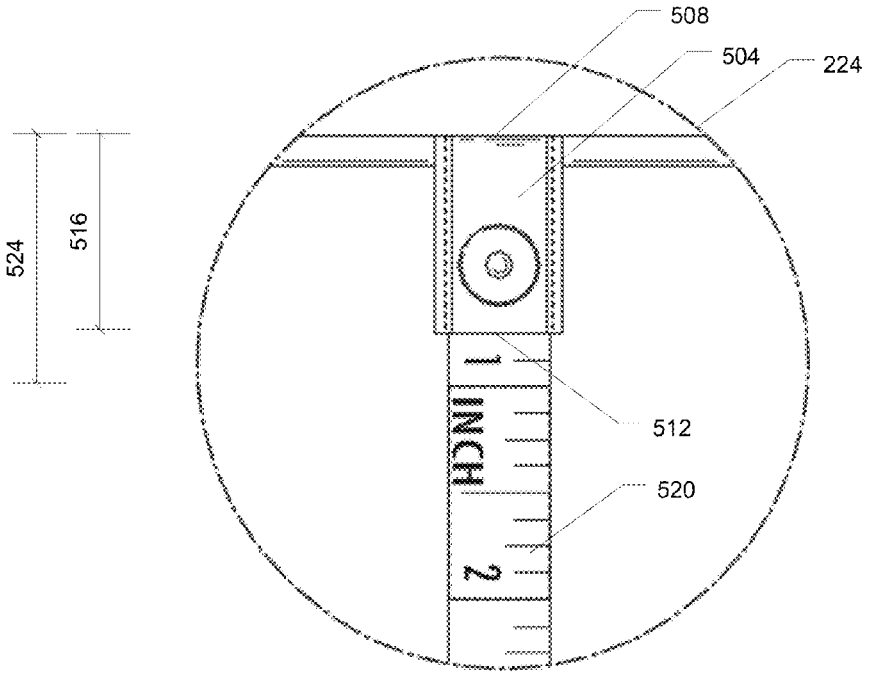
FIG. 5 shows a close-up view of the section indicated by the area in the circle in FIG. 2.
Figure 6:
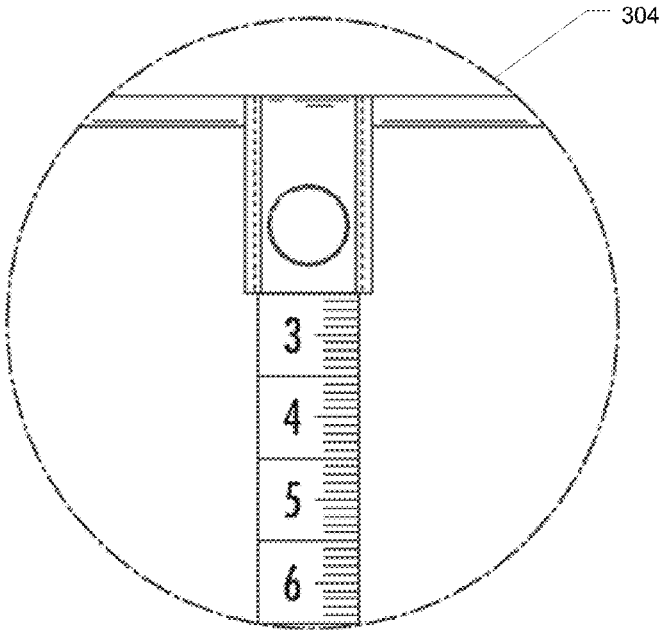
FIG. 6 shows a close-up view of the section indicated by the area in the circle in FIG. 3.

FIG. 5 shows a close-up view of the section indicated by the area in the circle in FIG. 2. FIG. 6 shows a close-up view of the section indicated by the area in the circle in FIG. 3. In FIG. 5, a fastener loop 504 has a top edge 508 and a bottom edge 512. Between top edge 508 and bottom edge 512 is a distance 516. Between a top of the belt and a 1-inch mark on a measuring tape 520 is a distance 524. Distance 524 is an inch from a top of the belt.

For this implementation, a reference point for shape measurements is from a top of the belt. However, for wider belts, the reference point may be chosen at other points of the belt, such as about in a center of the belt or somewhere between a top edge and bottom edge of the belt.

Distance 516 can vary and can be less than or greater than an inch. In various implementations, distance 516 is ¼ inch, ½ inch, ¾ inch, or greater. If distance 516 is greater than an inch, the 1-inch mark on the measuring tape would not be visible. In another implementation, the fastener is semi-transparent and distance 516 is greater than an inch. In this implementation, the 1-inch mark on the measuring tape is visible.

In an implementation, despite various distances 516, distance 524 remains the same. For example, in an implementation, distance 516 is ½ inch from a top of the belt, and distance 524 remains the same. The measuring tape is marked at the 1-inch mark an inch from the top of the belt, at the 2-inch mark two inches from the top of the belt, at the 3-inch mark three inches from the top of the belt, and so on.

In an implementation, the belt ties around a person's natural waist. The body bends at the natural waist. The natural waist can be found by having the person bend sideways and tying the belt at this location. In another implantation, the belt is tied at a location different from the person's natural waist. The place at which the belt is tied varies depending on the reference point or what the measurer desires to measure the girth or circumference of.

Figure 7:
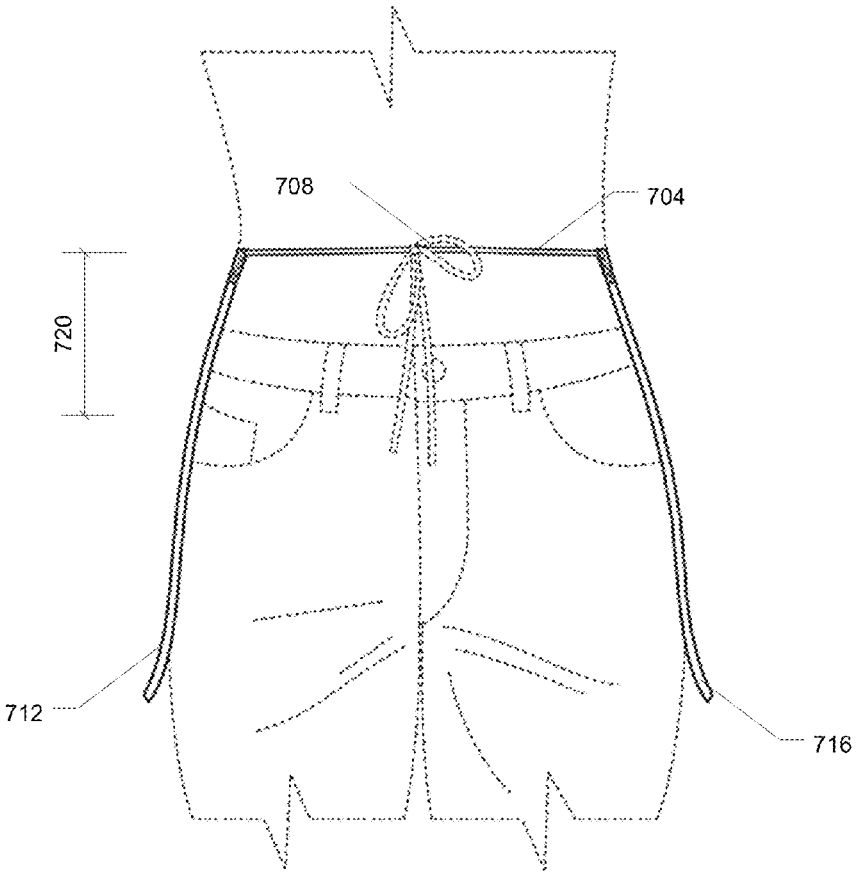
FIG. 7 shows a measuring tool having a string belt tied around a person's waist.
Figure 8:
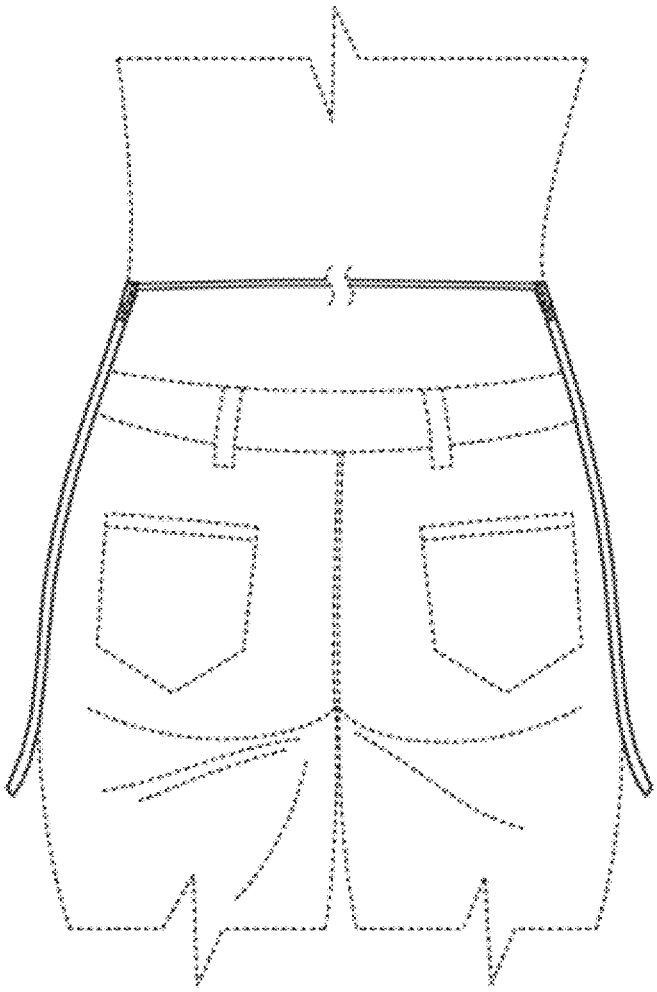
FIG. 8 shows a back view of the measuring tool having a string belt tied around the person's waist.
Figure 9:
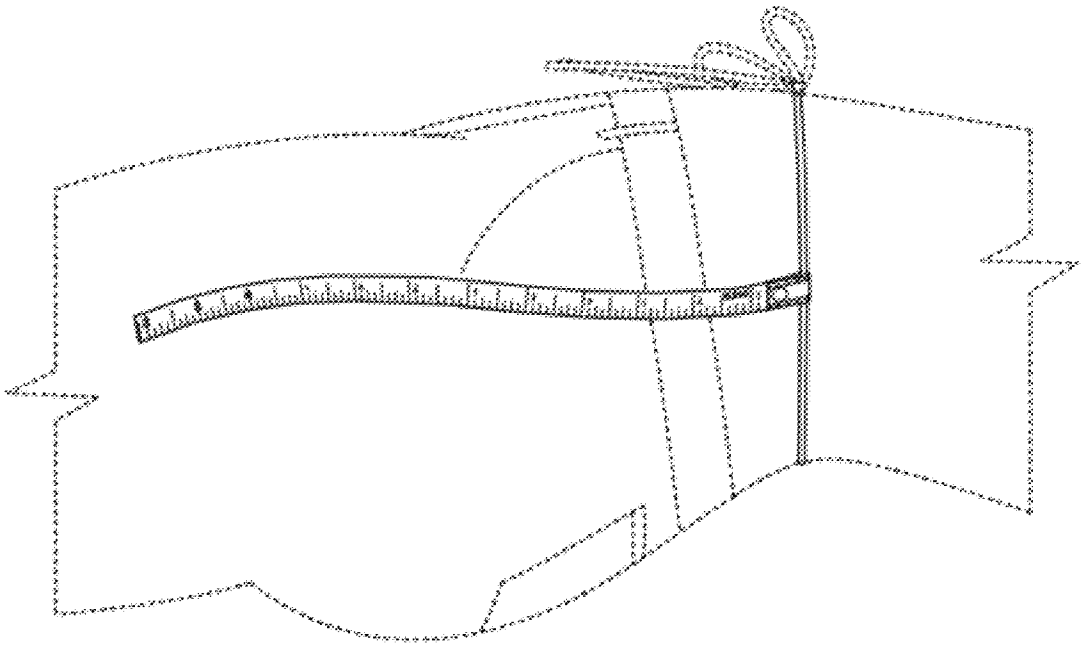
FIG. 9 shows a side view of the measuring tool tied around the person's waist.
Figure 10:
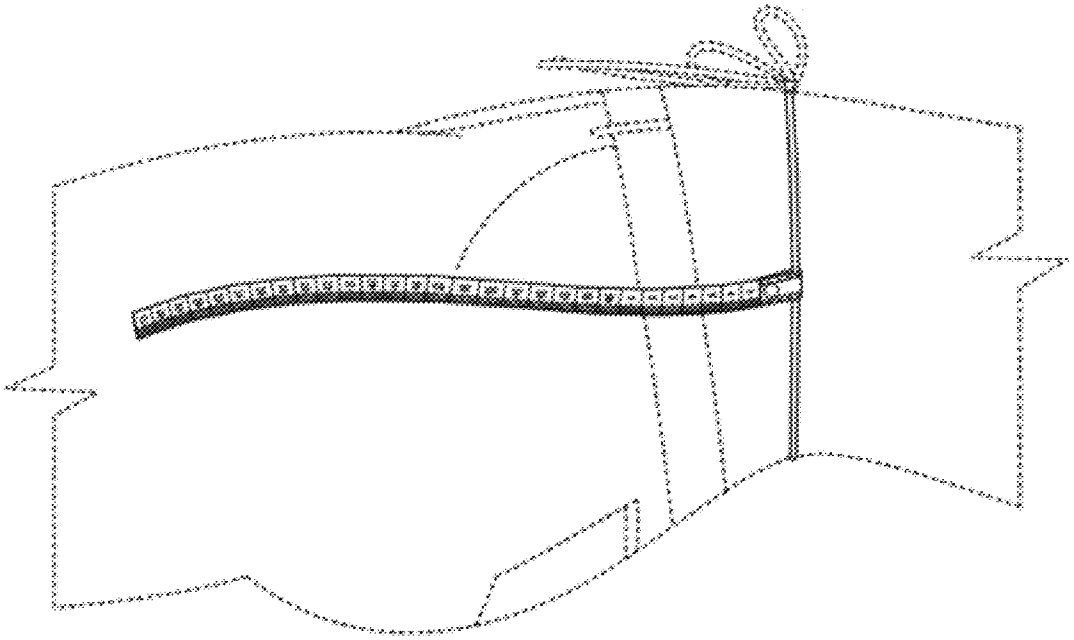
FIG. 10 shows a side view of the measuring tool tied around the person's waist.

FIG. 7 shows a measuring tool having a string belt 704 tied around a person's waist. The measuring tool has attached measuring tapes 712 and 716. FIG. 8 shows a back view of the measuring tool having a string belt tied around the person's waist. FIG. 9 shows a side view of the measuring tool tied around the person's waist. FIG. 10 shows a side view of the measuring tool tied around the person's waist.

String belt 704 can be secured around the person's waist by tying a bow 708. The string belt can be tied at any location of the person's waist (e.g., at a front, back, side of the person's body). In various implementations, the belt ties a little above or below the person's waist.

In the figures, the measuring tapes are at a side of the person's body. The measuring tapes can be located anywhere along the string belt of the measuring tool. For example, the measuring tapes can be located at a front and back of the person's body. In an implementation, the measuring tapes are located opposite from each other relative to the person's body. Measurements may be more accurate when the measuring tapes are at the sides of the person's body.

Further, in an implementation, the loops can slide across the string belt along an x-axis direction. In this implementation, a user can slide or move the measuring tapes as desired.

Generally, the belt of the measuring tool is arranged such that the belt can wrap around a person's body part. In an implementation, a length of the belt is sufficiently long to tie around a person's waist. The belt is adjustable such that it can fit and be secured around a person's waist. The belt can be used for people having different waist sizes. Then a belt having a length of at least 30 inches will be sufficient to support such people of various waist sizes. This length allows for measurement of a wide range of people. Lengths of the belt can be longer than 30 inches such as 35, 53, 53.5, 55, 58, 59, 60, or longer. In an implementation, the belt has a length between approximately 53.5 inches and 60 inches. In an implementation, the belt has a length less than 60 inches.

In an implementation, the belt has a width of about or approximately ¾ inches. A width of the belt can vary and can be greater than or less than ¾ inches. In an implementation, the belt has a width of at least ¾ inches. In an implementation, the belt has a width between approximately ¼ and 1 inch. In an implementation, the belt has a width of at least 1 inch. In an implementation, the belt has a width of 1.25, 1.5, or 2 inches.

Referring back to FIG. 7, a user can use a shape measuring tape to obtain measurements at particular distances from a top of the string belt. The user can obtain a measurement at a distance 720. For a more accurate measurement, the belt is substantially parallel to the floor or ground and is tied securely. For a more accurate measurement, the person can fold her arms in front of her chest keeping them in the same position throughout the measuring. The person can also stay evenly on both feet and keeps her legs together during the measurement. This contributes to a more exact measurement because having the person's legs apart could lead to a wider measurement at for example the hips.

In an implementation, the string belt is tied at the person's natural waist. A measurer can obtain a circumference or girth measurement at distance 720 from a top of the string belt (or other reference point). To obtain a girth measurement of the person's body at distance 720, the measurer utilizes attached measuring tape 712 or 716 to find distance 720.

After finding distance 720, the user can use a shape measuring tape, wrap the shape measuring tape around the person's body at distance 720, and obtain a measurement. For a more accurate measurement, the separate measuring tape should be substantially parallel to the floor or ground and at a substantially constant distance from the belt (e.g., at distance 720 all the way around).

A user can obtain measurements at more than one distance along attached measuring tapes 712 or 716. In an implementation, the measuring tool is utilized to measure a hip or seat circumference of a person. The hip measurement is performed a first distance from a top edge of the belt and the seat measurement is performed a second distance from the top edge of the belt. The second distance is greater than the first distance. The first distance is about 4 inches and the second distance is about 8 inches. The hip measurement can be subtracted from the seat measurement to obtain a difference. The difference can determine a category that the person falls into.

Figure 11:
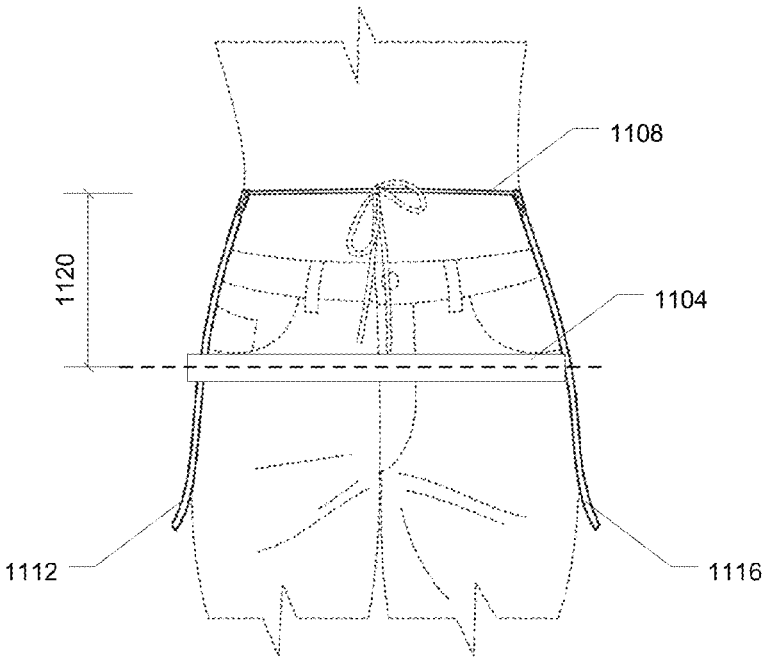
FIG. 11 shows a front view when a measuring tool is used to measure a girth of a person's body part.
Figure 12:
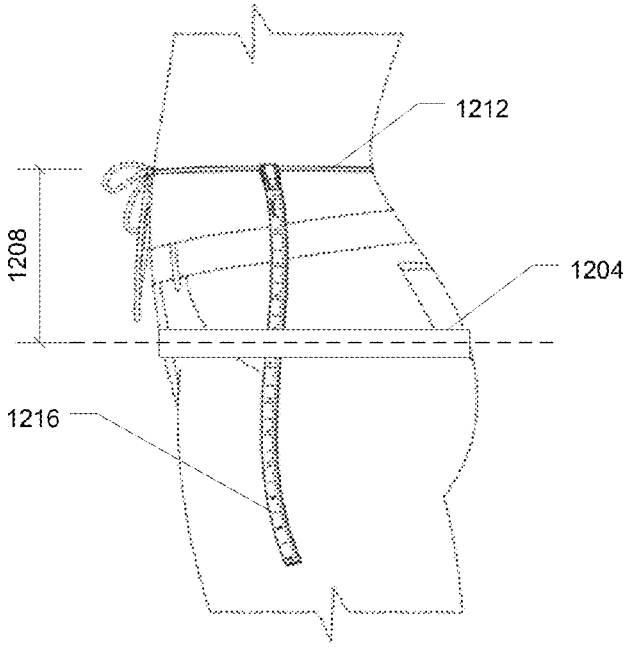
FIG. 12 shows a side view of using a measuring tool and a shape measuring tape to determine a girth measurement of a person's body part.
Figure 13:
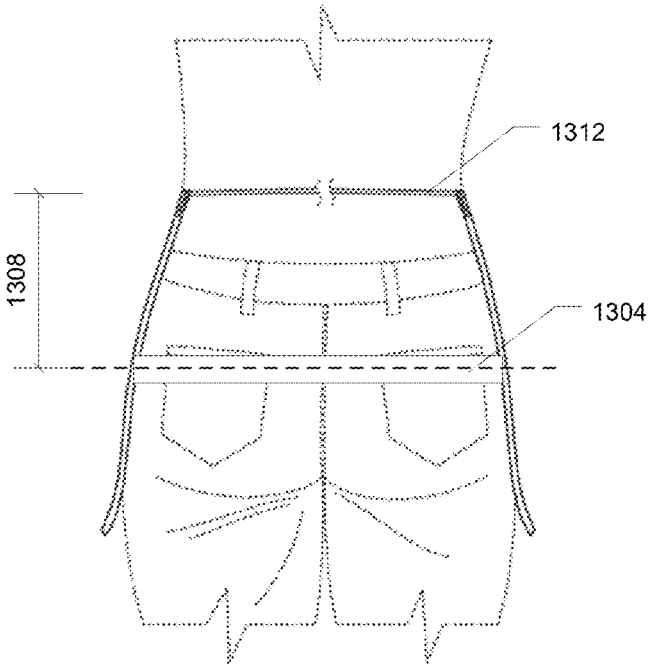
FIG. 13 shows a back view of a back view of using a measuring tool and a measuring tape to determine a girth measurement of a person's body part.

FIGS. 11-13 show a specific flow of using a measuring tool and a shape measuring tape. Some specific flows and techniques are described in this application, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

FIG. 11 shows a front view when the measuring tool is used to measure a circumference or girth of a person's body part. In a specific implementation, the measuring tool is used to measure the buttocks or seat of a person. This measuring tool is useful for obtaining accurate measurements of a person's buttock region, so that clothing will fit better, especially pants, jeans, and shorts.

As fashion, people desire to wear jeans that are tight-fitting and conformal to the buttocks. Such a fit can hug the body to accentuate curves. FIGS. 11 and 12 show an example of a good fit for jeans on a person. The jeans fit over the buttocks conformally and then narrow where the legs begin. There is not extra material which makes the jeans baggy or sag.

With off-the-rack jeans, good fit has been especially difficult to achieve because each person's buttocks has a different shape and size. This measuring tool will allow easy measurement of a person so that the person can be fitted appropriate to a pair of jeans or shorts.

The buttocks region extends from a natural waist, which is where the body, to about 12 inches below this. In a specific implementation, attached measuring tapes 1112 and 1116 are about 12 inches long. In other implementations, tapes 1112 and 1116 may be shorter such as 9 inches, 10 inches, or 11 inches.

Longer tapes, such as floor-length or longer (e.g., 50 inches long) measuring tapes are undesirable because they are unwieldy and unnecessary for measuring the buttocks area. For example, the person measured may step on tapes 1112 and 1116 (a tripping hazard). Tapes 1112 and 1116 may get twisted together and hard to separate. A kit with the measuring tool with very long tapes will be harder to unravel and put back together again into the kit, which takes time away from a sales associate from making a sale.

A measuring tool and a shape measuring tape can be used to measure a circumference or girth of a person's body part, such at one or more places on a person's buttocks. In an implementation of using this tool, the natural waist is a reference point in which measurements are made relative to. In other implementations, other reference points (e.g., belly button) may be used instead.

For a more accurate measurement, the person to be measured will be standing on a flat surface. The measuring tool has a belt 1108, which can be a string, that is used to secure the measuring tool to a person. With the belt, the measuring tool is put on a person and secured in place using, for example, a tie knot. Measuring tapes 1112 and 1116 are positioned at sides of the person. The belt will be horizontal or parallel with the flat surface which the person is standing on.

With the tool attached, one can make girth measurements around the person's buttocks at any desired distance relative to the point where the belt is tied (e.g., the natural waist). To determine a girth measurement at a distance 1120 from a reference point, a shape measuring tape 1104 (part of the measuring tool kit) is positioned horizontally at distance 1120 from the reference point. The user can obtain a girth measurement of the body at this distance by wrapping or encircling shape measuring tape 1104 around the body part at distance 1120.

By having the attached measuring tapes 1112 and 1116 at the person's sides, this makes it easier to make precise horizontal girth measurements because one can visually see that shape measuring tape 1104 is positioned at distance 1120 on both sides.

To obtain an accurate measurement when measuring, the tape measure should be kept level and close to the person's body. Placing shape measuring tape 1104 flat against the skin or as close as possible around the skin all the way around will aid in obtaining a consistent measurement. Also, a measurer's finger or fingers should be on top of shape measuring tape 1104, not underneath it. Further when measuring at the first distance, shape measuring tape 1104 should be placed horizontally at the first distance parallel to the string belt. In an implementation, when the measuring tape encircles the body to obtain a girth measurement at distance 1120, the measuring tape encircling the body part is at a constant distance 1120 all the way around the body.

Distance 1120 can vary depending on what girth measurements the measurer desires to obtain. In a specific implementation, distance 1120 is about 4 inches. In another implementation, distance 1120 is about 8 inches. Girth measurements may be taken at both 4 inches and 8 inches, and a difference calculated between the two measurements.

FIG. 12 shows a side view of using a measuring tool and a shape measuring tape to determine a girth measurement of a person's body part. A shape measuring tape 1204 is at a distance 1208 from a reference point of a belt 1212. An attached measuring tape 1216 is suspended from the belt. In an implementation, distance 1208 is substantially equal to distance 1120.

FIG. 13 shows a back view of a back view of using a measuring tool and a measuring tape to determine a girth measurement of a person's body part. A shape measuring tape 1304 is at a distance 1308 from a reference point on a belt 1312 of the measuring tool. In an implementation, distance 1308 is substantially equal to distance 1120.

The measurer can use attached measuring tapes 1112, 1116, or both, to find distance 1120. The measuring tapes of the measuring tool can be marked to more easily show the user where to obtain measurements. For example, in an implementation, a mark appears at distance 1120 on measuring tape 1112 so that a user can more easily ascertain where distance 1120 is and where to measure.

Figure 14:
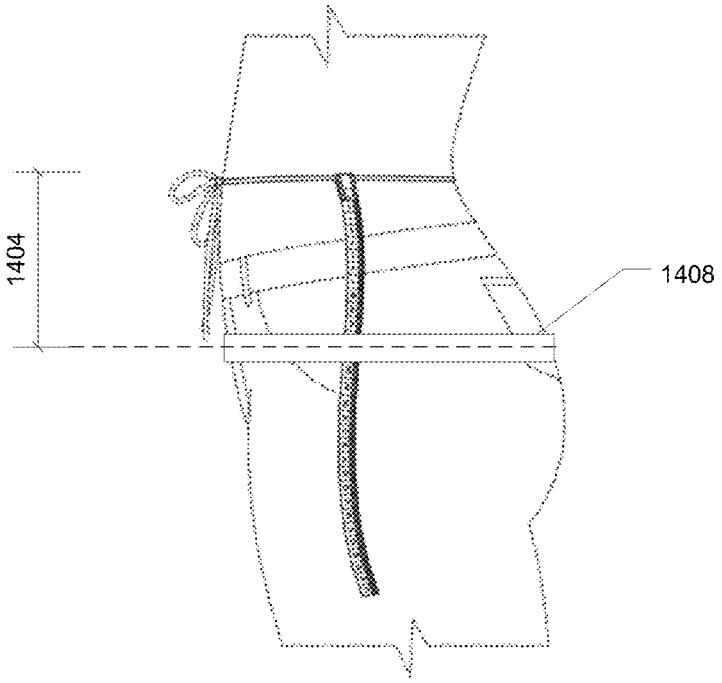
FIG. 14 shows a view of using a measuring tool and a shape measuring tape to determine a girth measurement of a person's body part.

FIG. 14 shows a view of using a measuring tool and a shape measuring tape to determine a girth measurement of a person's body part.

Further, the measurer can make any number of measurements using a measuring tool. This will depend on how many circumference measurements the measurer desires to obtain. The measurer can obtain 1, 2, 3, 4, 6, 9, 10, or more circumference measurements.

When the belt is secured to a person's waist, it may be difficult to keep the attached measuring tape in a flat downward position and pressed against the person's leg. The attached measuring tape may be flimsy and hard to manage. For example, the attached measuring tape may turn sideways or crumple when a person tries to get a measurement. Further, measurements by different measurers may unexpectedly yield different results. When measuring at particular points of the attached measuring tape, measurers may pull on the attached measuring tape with a different force. For example, if a first measurer tugs on the measuring tape with a first force, finds the "4" mark at a first location, and obtains a measurement of the circumference at that location, and a second measurer tugs on the measuring tape with a second force greater than the first force, finds the "4" mark at the second location, and obtains a measurement of the circumference at that location, the second location will be greater than the first location.

Figure 15:
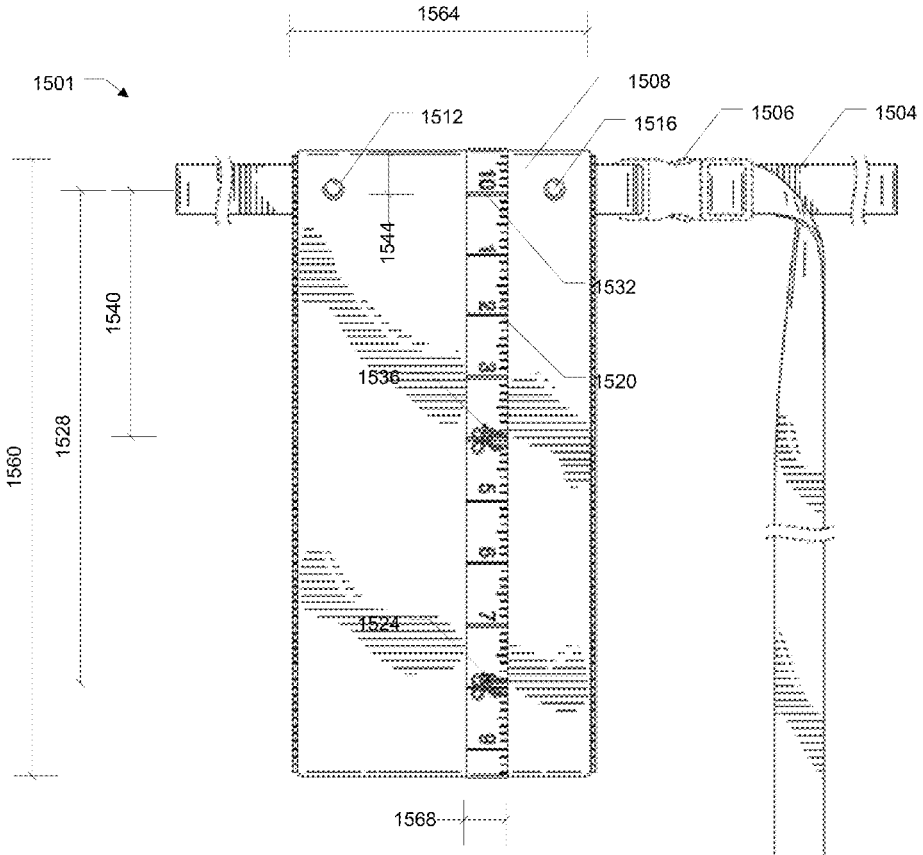
FIG. 15 shows a front view of a specific implementation of a measuring tool having a fabric panel.

FIG. 15 shows a front view of a specific implementation of a measuring tool 1501 having a fabric panel or anchor panel. The fabric panel assists in keeping the measuring tool flat so that it becomes unnecessary to pull on the measuring tape attached to the measuring tool. The measuring tool has a belt 1504 with a buckle 1506.

The belt is substantially horizontal to the ground in a first direction. The belt surrounds the person's waist. To get the belt snug around the waist, once the buckle of the belt is attached, a person can cinch the belt so that it is snug around the person's waist.

A fabric panel 1508 is attached or connected to the belt via a first fastener 1512 and a second fastener 1516. The first fastener punches through the fabric panel and the belt, and attaches or connects the flexible fabric panel to the belt. The second fastener punches through the fabric panel and the belt, and attaches or connects the flexible fabric panel to the belt. The fasteners can have any shape (e.g., circular, square, rectangular, diamond). Further, in an implementation, the first and second fasteners are rivets. There can be any number of fasteners that connect the fabric panel to the measuring tool (e.g., 1, 2, 3, 4, 5, or more). This can depend on a variety of factors such as a material of the fabric panel, how strong the fasteners, a length of the fabric tool, or manufacturing costs. Further, the fabric panel can be attached to the belt using a variety of techniques (e.g., glued, stapled, or other).

A first side of the fabric panel has ruled markings or graduated markings 1520. In an implementation, a measuring tape is mounted or disposed on the fabric panel. The belt extends in a first direction. When the belt is secured to a person's waist, the first direction is substantially horizontal to the floor. The ruled markings extend in a second direction, substantially transverse to the first direction. In an implementation, the ruled markings include United States customary units. In another implementation, the ruled markings include the International System of Units. In an implementation, the ruled markings include United States customary units and the International System of Units. In an implementation, the ruled markings are a measuring tape attached to the fabric panel. In another implementation, the ruled markings are visible measurements written on the fabric panel.

A first hook 1524 is attached to the fabric panel at a first distance 1528 from a reference point 1532. The first hook is positioned at the first distance and points in the first direction. A second hook 1536 is attached to the fabric panel at a second distance 1540 from the reference point 1532. The second hook is positioned at the second distance and points in the first direction. The first distance is greater than the second distance.

The first distance is measured from the reference point. Between a top side and a bottom side of the belt is the reference point. Between the top edge of the fabric panel and the reference point is a distance 1544. Distance 1544 may vary. In an implementation, distance 1544 is about ⅝ inch. In various implementations, distance 1544 is about ¼, ⅓, ½, ¾, 2 inches, or greater.

The reference point aligns at different positions. In various implementations, the reference point is located at a midway point of a width of the belt, off-center of a width of the belt, above a midway point of a width of the belt, and below a midway point of a width of the belt. In an implementation, when the measuring is secured around a person's waist, the reference point aligns with the person's natural waist. In various implementations, when the measuring tool is secured around a person's waist, the reference point aligns above or below the person's natural waist. Further, in various implementations, the reference point is a point relative to other components of the measuring tool (e.g., fabric panel or buckle of the belt). Further, a first and second distance can be from different reference points.

The measurer can feel for the hooks. In an implementation, the ruled markings are markings directly on the fabric panel and the hooks are connected directly to the fabric panel. In another implementation, the ruled markings are a measuring tape attached to a surface of the fabric panel and hooks are connected directly to the measuring tape.

In an implementation, the fabric panel is a flexible fabric panel. This allows the measuring tool to be wound up and placed for example in a small pouch. When the fabric panel is made of a flexible material, this allows a user to easily carry the measuring tool around in a bag. The measuring tool will not take up a lot of space. In another implementation, the fabric panel is a rigid fabric panel.

The fabric panel has a length 1560 (e.g., longer side) and a width 1564 (e.g., shorter side). A length and width of the fabric panel can depend on a variety of factors such as the length or width of the measuring tape or manufacturing costs.

The fabric panel includes ruled markings so the measuring tape attached to the measuring tool is easy to manage. Generally, a length 1560 of the fabric panel is sufficiently long to measure a person's shape in the waist, seat, and hip area. A length and width of the measuring can vary. In a specific implementation, length 1560 of the fabric panel is about 10 inches and a width 1564 of the fabric panel is about 4.5 inches. In an implementation, the length is 6.0, 6.5, 7.25, 8.15, 8.75, 9, 9.5, 9.75, 10.5, 11, or greater than 11 inches. The width of the fabric panel can be greater than or less than 4.5 inches. In an implementation, the width is 0.5, 0.75, 1, 1.5, 2, 2.25, 3.75, 4.25, 5, 6, 6.25, or greater then 6.25 inches.

The length of the fabric panel is about the same as the ruled markings. The lengths of the fabric panel and the ruled markings, however, do not necessarily have to be the same. For example, in a specific implementation, length 1560 of the fabric panel is shorter than a length of the ruled markings In another implementation, length 1560 of the fabric panel is longer than a length of the ruled markings.

The ruled markings or measuring tape on the side of the fabric panel has a length 1560 and a width 1568. The length of the width of the measuring tape can vary. In an implementation, a length of the measuring tape is about 10 inches and a width of the measuring tape is about ½ inch. In various implementations, the length of the measuring tape is 8.25, 8.75, 9, 9.5, 9.75, 10.5, 11, or greater than 11 inches. As discussed above, when the attached measuring tape is unnecessarily long (e.g., touches the floor), the attached measuring tape can become unwieldy. In various implementations, the width of the fabric panel is ⅛, ¼, ⅜, ¾ inch, or greater. The width of the measuring tape can be less than or greater than the fabric panel.

Figure 16:
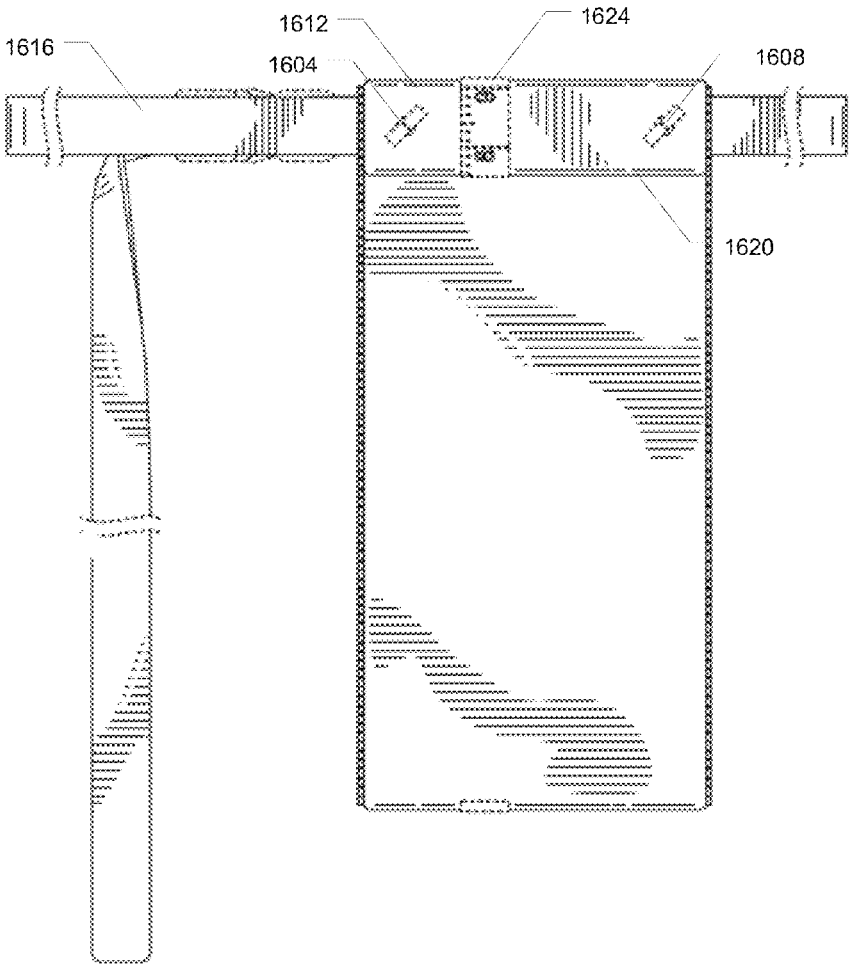
FIG. 16 shows a back view of the measuring tool with the belt buckled.

FIGS. 16-21 show different views of the measuring tool. FIG. 16 shows a back view of the measuring tool with the belt buckled. Fasteners 1604 and 1608 connect a fabric panel 1612 to a belt 1616 of the measuring tool. A portion of the fabric panel loops around the belt to a second or back side of the fabric panel. An end of the fabric panel can be attached to a side of the fabric panel to make a loop around the belt. In various implementations, the end of the fabric panel is bolted, stitched, or sewn to the back side of the fabric panel at a line 1620. When the fabric panel is bolted to the belt, the fabric panel cannot slide along a length of the belt.

In another implementation, the fabric panel is capable of sliding along the belt. For example, the fabric panel can make a loop around the belt big enough such that the fabric panel can slide along a length of the belt.

A portion of the ruled markings or measuring tape 1624 also loops around the belt to the back side of the fabric panel. An end of the measuring tape is stitched or sewn such that it is visible from the back of the fabric panel. The ruled markings may or may not be visible on a back side of the measuring tool.

Figure 17:
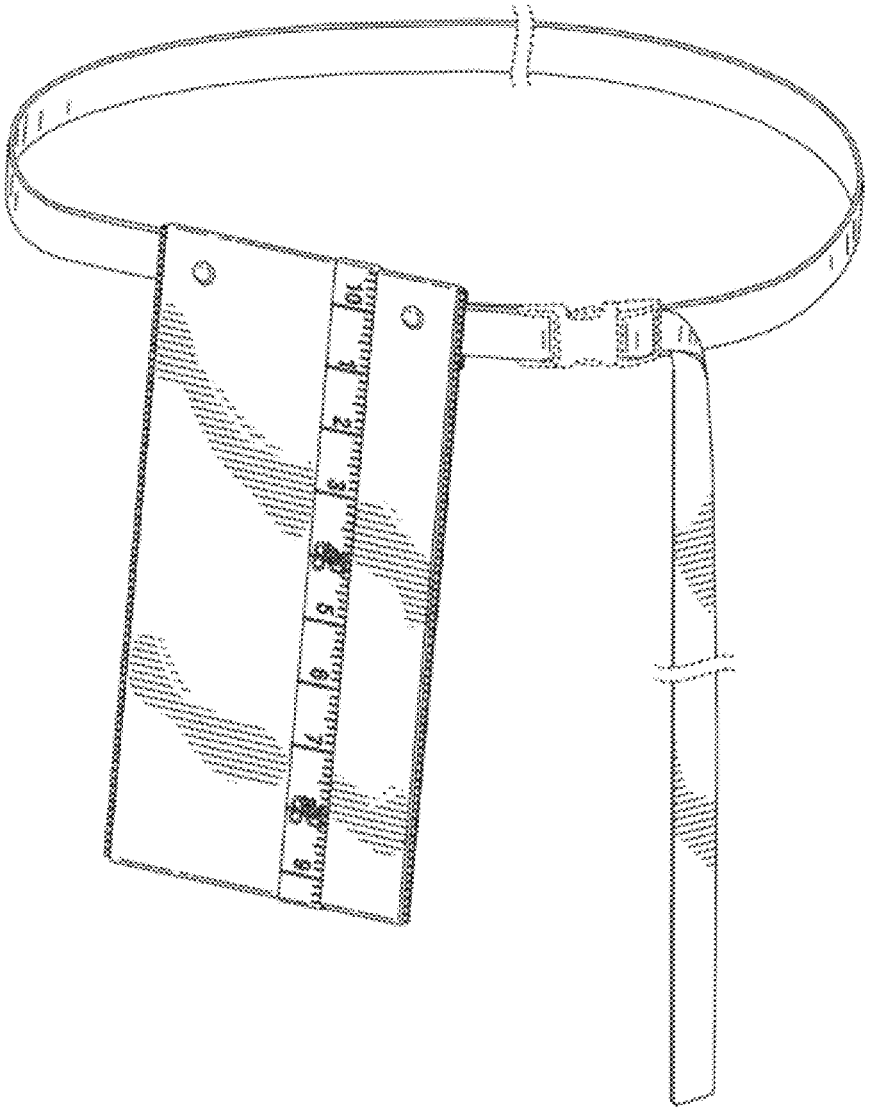
FIG. 17 shows a perspective view of the measuring tool.
Figure 18:
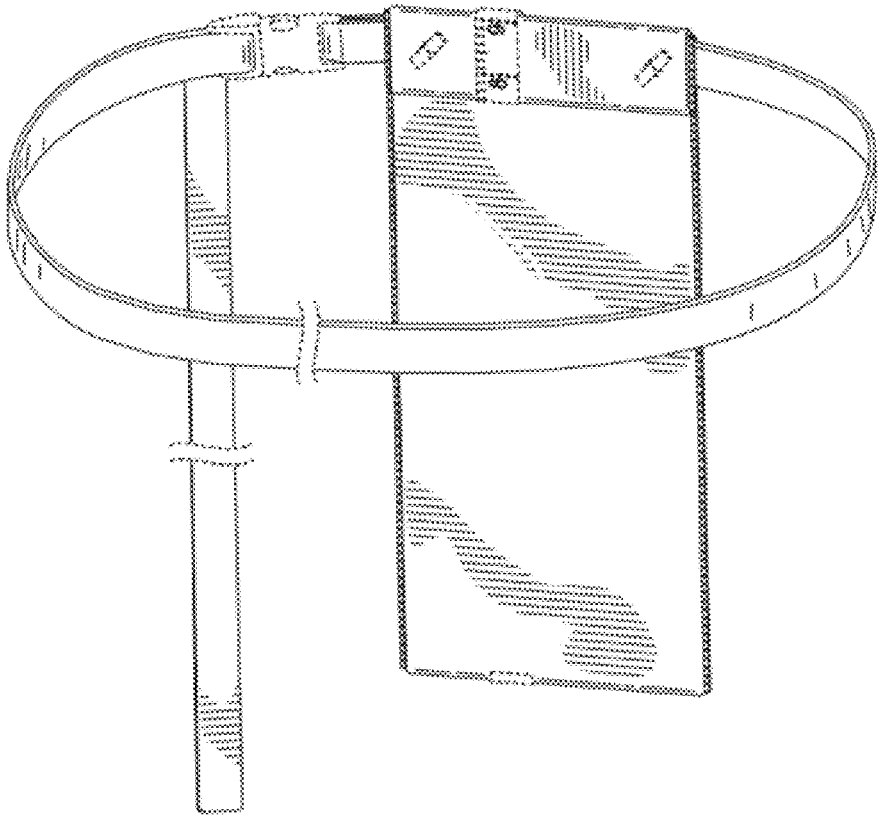
FIG. 18 shows another perspective view of the measuring tool.

FIG. 17 shows a perspective view of the measuring tool. FIG. 18 shows another perspective view of the measuring tool.

Figure 19:
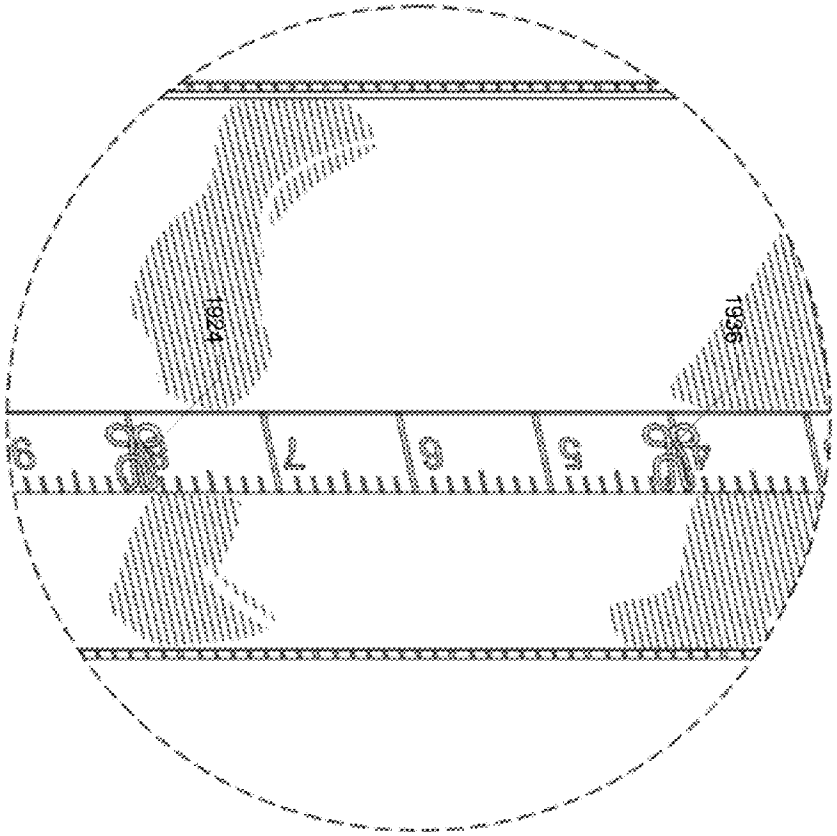
FIG. 19 shows a close-up view of the hooks in FIG. 15.

FIG. 19 shows a close-up view of the hooks in FIG. 15. Hooks 1924 and 1936 have rounded hooks and are less likely to harm a person using it since the curves are smooth. The hooks are less likely to catch or puncture for example a person or surrounding objects and materials.

In various implementations, a hook is a double hook, U-hook, sewing hook, loop hook, or other hook. In another implementation, instead of a hook, a clip, clasp is used.

Figure 20:
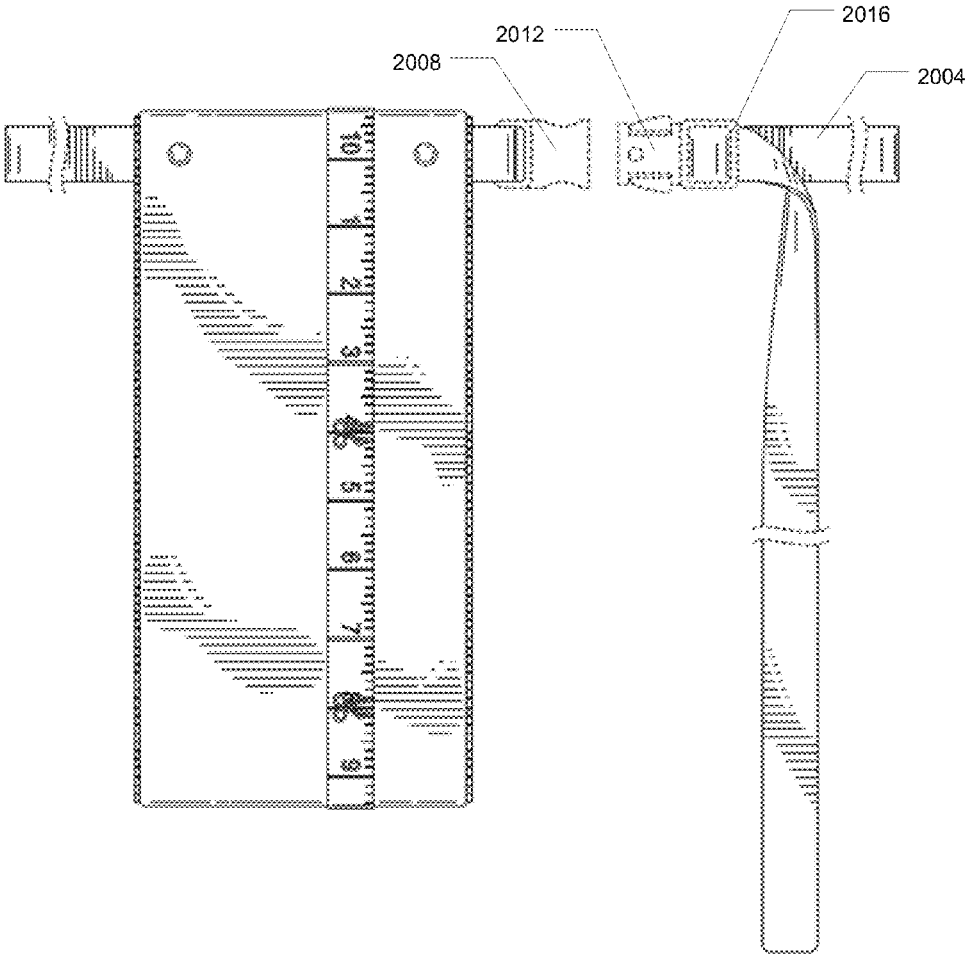
FIG. 20 shows a front view of a belt of the measuring tool.

FIG. 20 shows a front view of a belt of the measuring tool. A side-release belt 2004 is unbuckled. The belt has a first-end buckle 2008 and a second-end buckle 2012. When the belt is buckled, the first-end buckle connects or joins to the second-end buckle. The belt includes a loop 2016 through which portions of the belt are fed through. The loop allows the belt to be adjustable when a user pulls portions of the belt through the loop or loosens the belt.

The measuring tool can be used with a shape measuring tape to obtain a girth measurement. For example, when the measuring tool is secured to a person's waist, a user can easily find a distance below a reference point relative to the belt and obtain a girth measurement at that distance.

Figure 21:
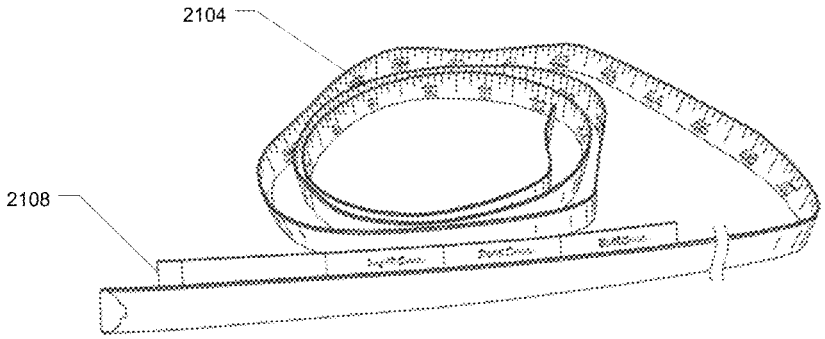
FIG. 21 shows a perspective view of a specific implementation of a shape measuring tape.

FIG. 21 shows a perspective view of a specific implementation of a shape measuring tape 2104. Generally, a length of the shape measuring tape is sufficiently long to measure a person's waist, seat, or hip measurement. In a specific implementation, a length of the shape measuring tape is about 59 inches. Then a shape measuring tape length of at least 39 (e.g., 40, 53.5, 54, 55, 56.5, 58, 58.5, 59, 59.5, or greater) will be sufficient to support such a measurement. The shape measuring tape has a general tab 2108 that sets forth three categories a person can fall into.

Figure 22:
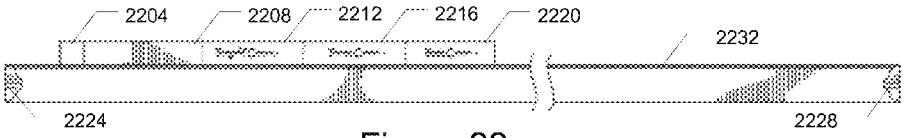
FIG. 22 shows a front view of a shape measuring tape having three categories.

FIG. 22 shows a front view of a shape measuring tape having three categories. A general tab of the shape measuring tape has a starter tab 2204, blank tab 2208, slight curve category tab 2212, demi curve category tab 2216, and bold curve category tab 2220. The general tab is closer to a first side end 2224 than a second side end 2228.

The tabs can be any color or pattern depending in the user preference or manufacturer preference. Further, categories can be visible on only one side of the shape measuring tape or both sides of the shape measuring tape.

The shape measuring tape has a first or front side and a second or back side (not shown). Between the front side and the back side is the general tab. A bottom edge of the general tab may not be visible from the front or back side of the shape measuring tape.

In an implementation, a shortest distance between first side end 2224 and a side of starter tab 2204 is about 1.5 inches, a distance from a left side of the starter tab to a right side of the starter tab is about ⅜ inch. A length (e.g., longer side) of blank tab 2208 is about 1.5 inches, a length of slight curve category tab 2212 is about 1.5 inches, a length of demi curve category tab 2216 is about 1.5 inches, and a length of bold curve category tab 2220 is about 1.5 inches.

These distances can vary depending on the categories and their specific measurements. The tabs can be the same or different lengths from each other. The general tab of the shape measuring tool can have any number of categories (e.g., 1, 2, 3, 4, or more categories). Further, in other implementations, the blank is not present and the starter tab is adjacent to a category tab.

The tabs can protrude or extend above a first or top side edge 2232 of the shape measuring tape. This can make it easier for a user to determine a category that the person falls in. In an implementation, the tabs protrude about ⅜ inch above a top side edge of the shape measuring tape. In various implementations, the tabs protrude less than ⅜ inch (e.g., ¼) or greater than ⅜ inch (e.g., ½, ⅝, or greater).

Figure 23:
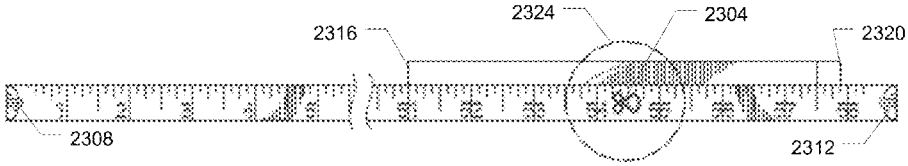
FIG. 23 shows a back view of the shape measuring tape having an eye.

FIG. 23 shows a back view of the shape measuring tape having an eye 2304. The measuring tape has an eye that can removably connect or link to a hook (e.g., hook 1524, 1536, or both) onto the measuring tool (e.g., a side of a measuring tape attached to a measuring tool, ruled markings, or fabric panel).

When a user wishes to obtain a girth measurement at for example distance 1528 (FIG. 15), a user can feel for hook 1524 and connect or link the eye of the shape measuring tape to the hook of the shape measuring tape. The hook and eye will easily connect and disconnect and allow a user to take the measurement at the first distance. The measurer can obtain a measurement of the circumference of a person's body at that location or distance. A user can obtain measurements at locations different from the locations of the hooks. For example, a use can obtain a measurement at a location above the first distance, at a location between the first and second distances, or at a location below the second distance.

The shape measuring tape has a first side end 2308 and a second side end 2312. The eye is closer to the second side end and points to the second side end. The eye is within a left 2316 and right 2320 side of the general tab on the back of the shape measuring tape. A shape measuring tape can have any number of eyes that are connectable to a hook. The eye or eyes can be located on the front side, back side, or both, of the shape measuring tape. An area in a circle 2324 indicates the eye (see FIG. 25).

Figure 24:
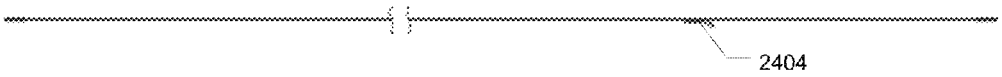
FIG. 24 shows a side view of the shape measuring tape having an eye.
Figure 25:
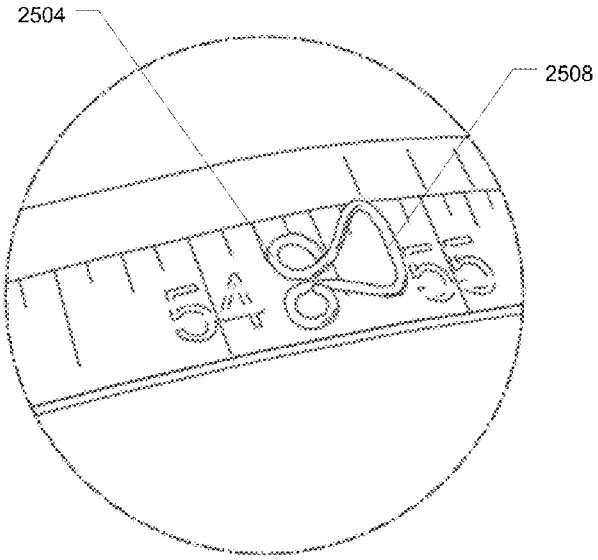
FIG. 25 shows a close-up view of the eye indicated by the area in the circle in FIG. 23.

FIG. 24 shows a side view of the shape measuring tape having an eye 2404. FIG. 25 shows a close-up view of the eye indicated by the area in the circle in FIG. 23. A first end 2504 of the eye is at about 54.25 inches from a first side of the shape measuring tape. A second end 2508 of the eye is at about 54.75 inches from the first side of the shape measuring tape. The eye has a length from the first side to the second side of about ½ inch.

The eye can be attached to the shape measuring tape through a variety of ways. For example, the eye can be sewn, stitched, or glued to the shape measuring tape.

As discussed above, the measuring tool can be used to obtain girth measurements of a person's body. To keep track of a measurement, an indicator clip can be attached to the shape measuring tape.

Figure 26:
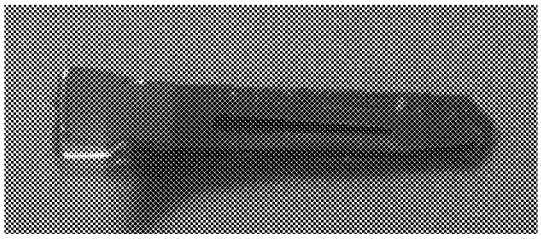
FIGS. 26-28 show views of a specific implementation of an indicator clip.
Figure 27:
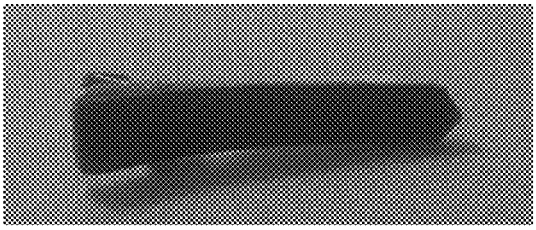
Figure 28:
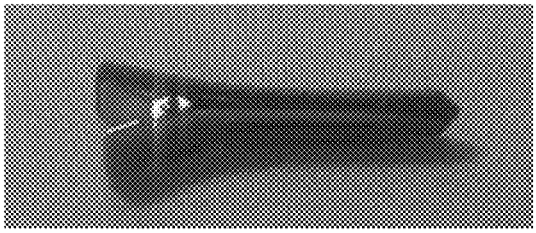

FIGS. 26-28 show views of a specific implementation of an indicator clip or calibration marker. The indicator clip attaches to the measuring tape to keep track of measurements taken (more details below).

Figure 29A:
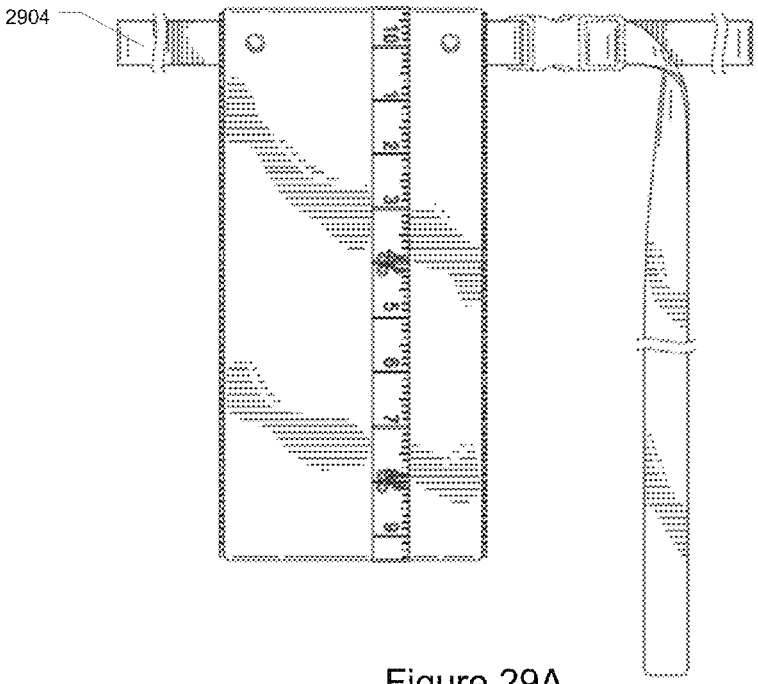
FIGS. 29A-29C show a specific implementation of a measuring tool kit having a measuring tool, a shape measuring tape, and an indicator clip.
Figure 29B:
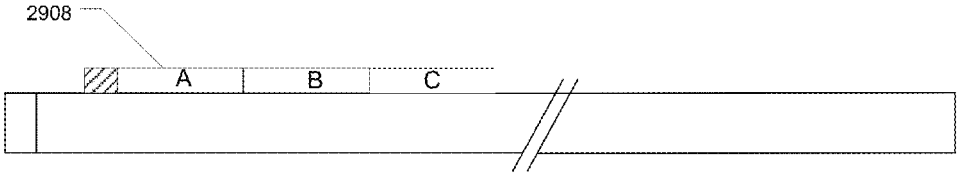
Figure 29C:
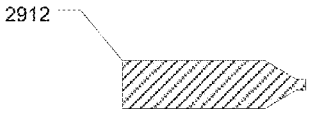

FIGS. 29A-29C show a specific implementation of a measuring tool kit having a measuring tool 2904 (described in FIG. 15), a shape measuring tape 2908, and an indicator clip 2912. FIG. 29A shows a specific implementation of the measuring tool. FIG. 29B shows a specific implementation of the measuring tape. FIG. 29C shows a specific implementation of the indicator clip.

FIGS. 30-37 show a specific flow of using the measuring tool, shape measuring tape, and indicator clip in FIGS. 29A-29C. The method can be used for measuring body shape for fitting jeans. Some specific flows and techniques are described in this application, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

1. Attaching a belt of a measuring tool to a person to be fitted, where the tool comprises a flexible panel with ruled markings extending in a direction perpendicular to the belt. The flexible panel is connected to the belt.

Figure 30:
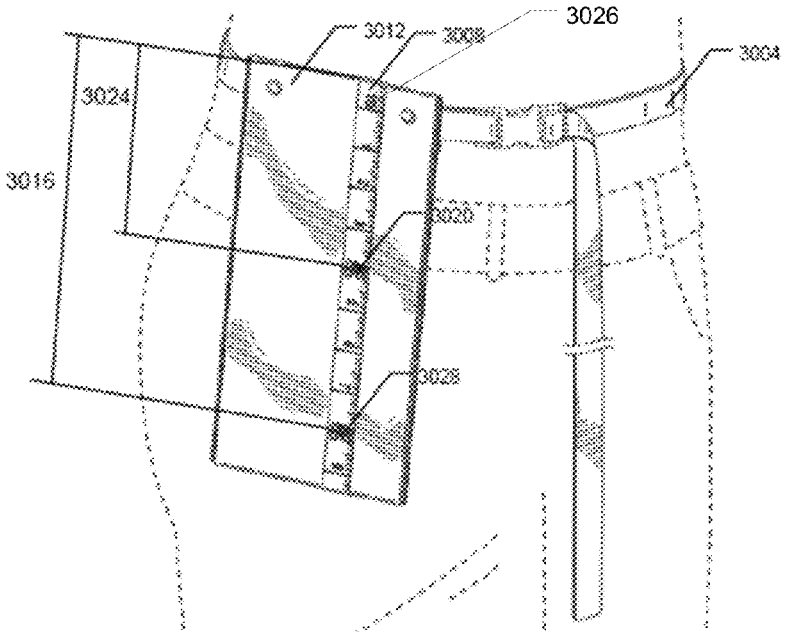
FIG. 30 shows a measuring tool attached to a person to be fitted.

FIG. 30 shows a measuring tool attached to a person to be fitted. A belt 3004 of the measuring tool is attached to a person to be fitted. The measuring tool also includes ruled markings or a first measuring tape 3008 and flexible fabric panel 3012. The flexible fabric panel is connected to the belt. The flexible panel has ruled markings extending in a direction substantially perpendicular to the belt.

At a first vertical first distance 3016 along a y-axis from a reference point 3026 is a hook 3028. At a second vertical distance 3024 along a y-axis from the reference point is a hook 3020. The second distance is less than the first distance. In an implementation, a circumference or girth measurement at the first distance is a seat measurement and a circumference or girth measurement at the second distance is a hip measurement.

2. Using the ruled markings as a guide, holding a shape measuring tape at a first distance from the belt.

Figure 31:
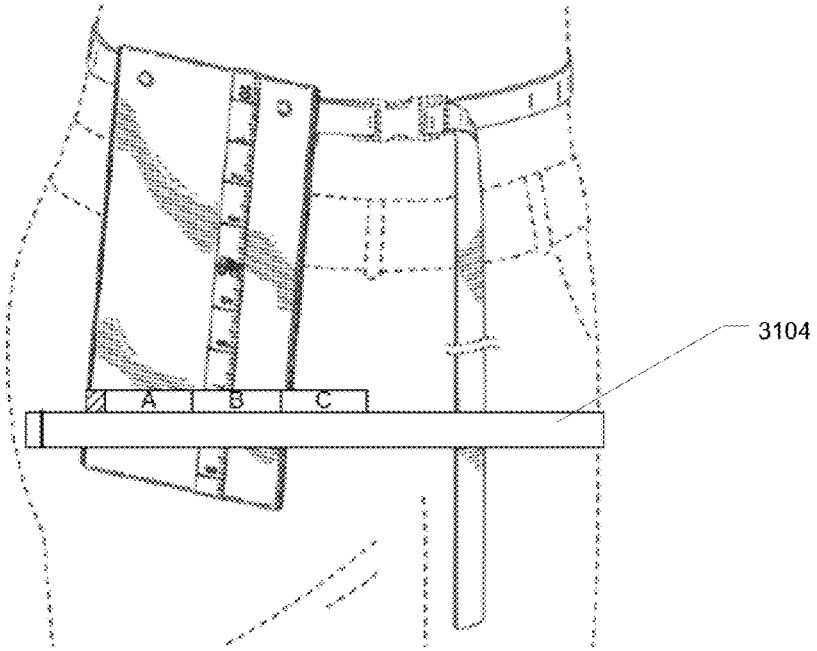
FIG. 31 shows a shape measuring tape.

FIG. 31 shows a shape measuring tape 3104. The shape measuring tape has an eye on a back side of the shape measuring tape (not shown) that can removable join or link to hook 3020, hook 3028, or both. A person can hold shape measuring tape 3104 with the tab facing her (e.g., showing category tabs A, B, and C). In an implementation, for a first measurement, the measurer joins the eye of the shape measuring tape to hook 3028 of the first measuring tape or fabric panel.

3. Extending the shape measuring tape around the person so the measuring tape is about parallel with the belt.

Figure 32:
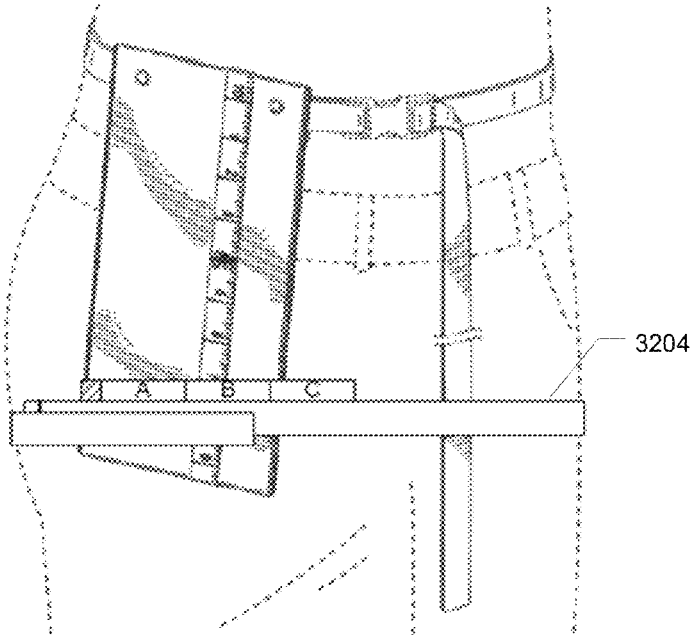
FIG. 32 shows a shape measurement tape extended around the person to be measured.

FIG. 32 shows a shape measurement tape 3204 extended around the person to be measured. While keeping the shape measuring tape level, the measurer wraps the shape measuring tape around the person being measured at the first distance. The shape measuring tape is about level with the belt. The shape measuring tape is about parallel with the belt.

4. Using markings on the second measuring tape, determining a first girth for the person at the first distance from a reference point.

In an implementation, determining a first girth for the person at the first distance from the reference point includes attaching an indicator to a position on the second measuring tape.

Figure 33:
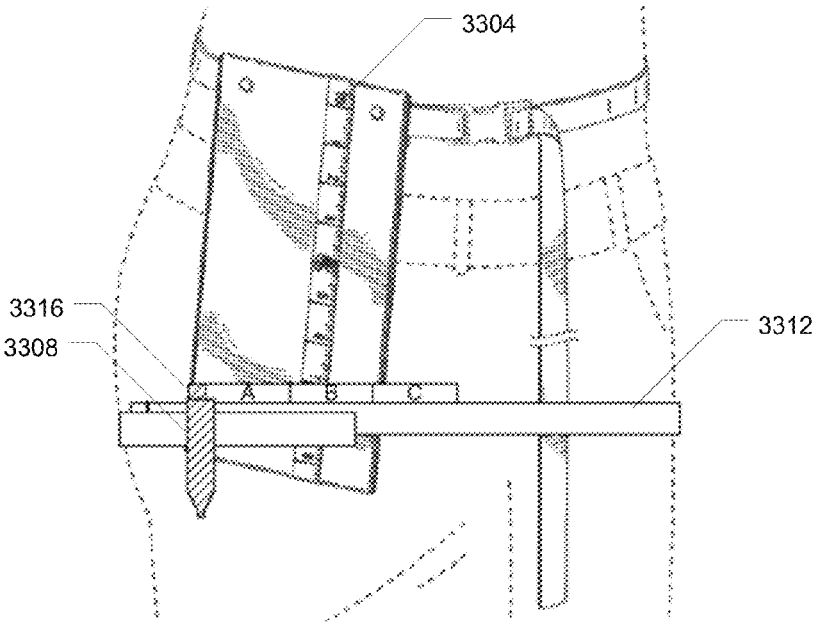
FIG. 33 shows a first measurement at a first distance from a reference point.

FIG. 33 shows a first measurement at a first distance from a reference point 3304. An indicator clip 3308 is attached or clipped to a shape measuring tape 3312 at the first measurement. To save the first measurement, the measurer aligns the indicator clip with a starter mark or a patterned mark 3316 associated with the shape measuring tape and attaches the indicator clip to the shape measuring tape at the first measurement.

5. Using the ruled markings as a guide, holding the second measuring tape at a second distance from the reference point.

Figure 34:
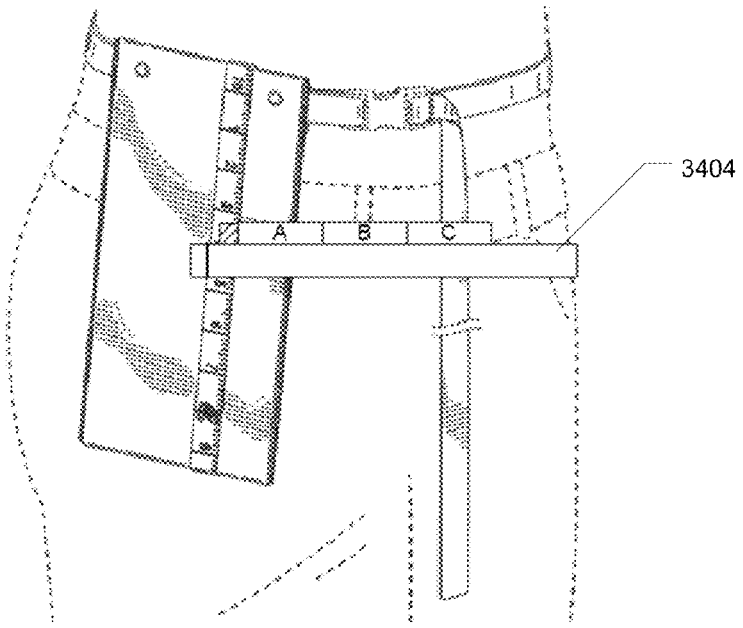
FIG. 34 shows the shape measuring tape linked to a hook.

FIG. 34 shows the shape measuring tape linked or joined to hook 3020. The shape measuring tape has an eye on a back side of the shape measuring tape (not shown). For a second measurement, the measurer hooks the eye of the shape measuring tape to hook 3020 of the first measuring tape or fabric panel.

6. Extending the shape measuring tape around the person so the shape measuring tape is about parallel with the belt.

Figure 35:
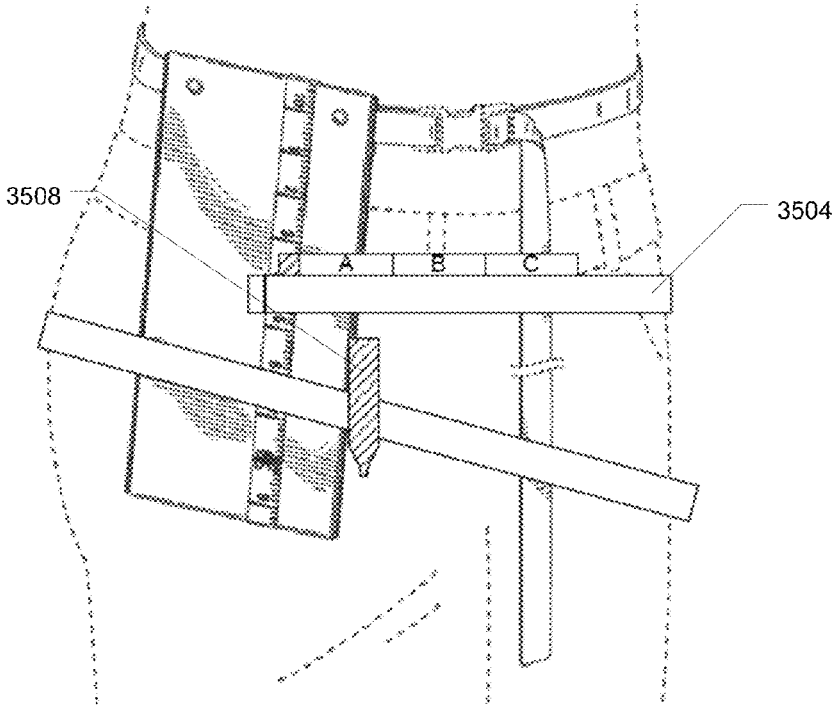
FIG. 35 shows an indicator clip attached to a shape measuring tape.

FIG. 35 shows a shape measuring tape 3504 and an indicator clip 3508 attached to the shape measuring tape. While keeping the shape measuring tape level, the measurer wraps the shape measuring tape around the person's body at the second distance (e.g., hip circumference). The shape measuring tape is about parallel with the belt. For a more accurate measurement, the measurer should be careful not to slide or distort the indicator clip marking the first measurement. In an implementation, the second distance is less than the first distance.

7. Using the markings on the shape measuring tape and the attached indicator, determining a jean fit category for the person.

In an implementation, determining an indicated jean fit category for the person includes reading the jean fit category which the attached indicator clip aligns with or points to on the shape measuring tape.

Figure 36:
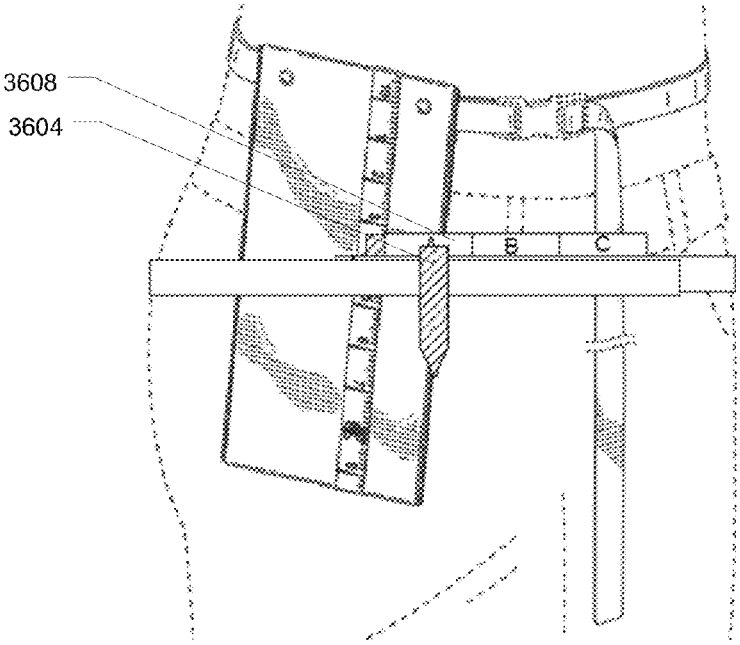
FIG. 36 shows an indicator clip that aligns with a category A tab on the shape measuring tape.

FIG. 36 shows an indicator clip 3604 that aligns with a category A tab 3608. A location at which the indicator clip aligns with a category tab determines the category the person falls into. In this case, the person falls into a category A jean fit category.

Figure 37:
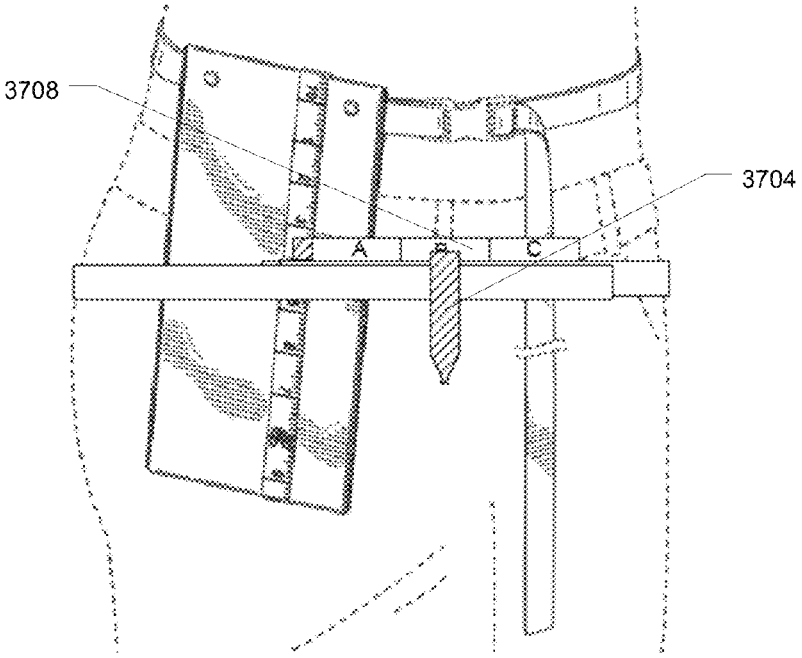
FIG. 37 shows a second measurement having an indicator clip that points to a category B tab on the shape measuring tape.

In another implementation, a person falls into a category B jean fit category. FIG. 37 shows a second measurement having an indicator clip 3704 that points to category B tab 3708 on the shape measuring tape.

These measurements can be used to place the person into a category. For example, in an implementation, the first measurement at the first distance is subtracted from the second measurement at the second distance to obtain a difference. A difference between a hip measurement and a seat measurement were described above. The difference is used to determine a category of a plurality of categories the person can belong in.

In an implementation, the measurements are part of a fitting system, and the categories are three body shapes. In an implementation, the difference is a Levi's® curve ID. The fitting system can have more than less than three body shapes or more than three body shapes. For example, a fitting system can have 2, 4, 5, or more body shapes.

In an implementation, a measuring tool used to wrap around the person can be adjusted so that subtracting two measurements to obtain a difference is unnecessary.

Other items can be used instead of the indicator clip to mark a measurement on the measuring tape. For example, in an implementation, a measurer uses a pen or highlighter or other writing instrument to mark the measuring tape to signify a specific girth measurement taken. In another implementation, a measurer uses a sticker to mark the measuring tape to signify a measurement taken.

The shape measuring tape can have a fastener different from an eye. For example, in other implementations, the shape measuring tape has a hook, clasp, clip, or other fastener that can link the shape measuring tape to the fabric panel.

Figure 38:
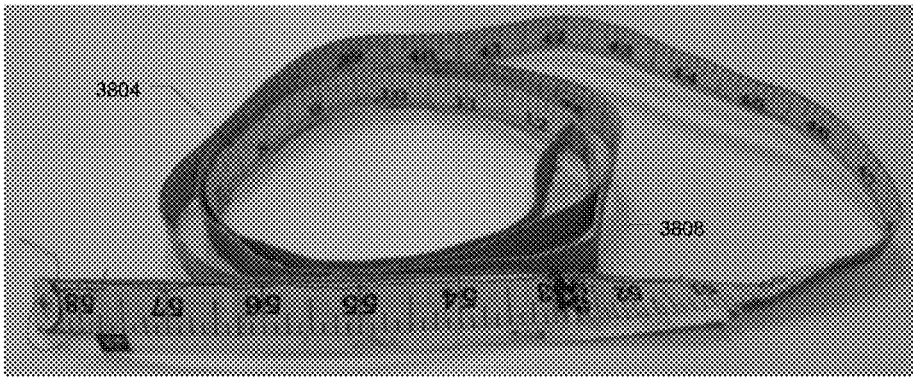
FIG. 38 shows a perspective view of a shape measuring tape.

An eye of the shape measuring tape can be attached at varying positions along a length of the tape. FIG. 38 shows a perspective view of a shape measuring tape 3804. The shape measuring tape is at least 53 inches long. An eye 3808 is positioned or located at about 53 inches from a side end of the shape measuring tape. The eye points toward a short end of the shape measuring tape. The eye is closer to the short end.

Figure 39:
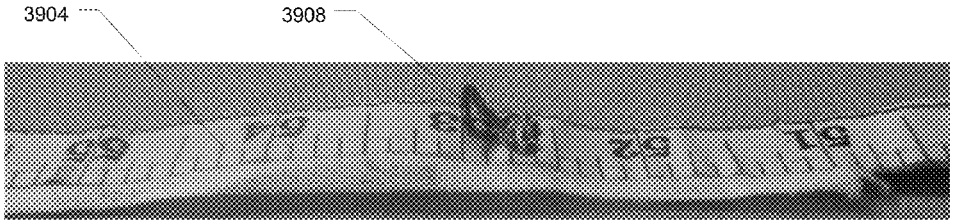
FIG. 39 shows a close-up view of a shape measuring tape and an eye near the 53-inch mark of the shape measuring tape.
Figure 40:
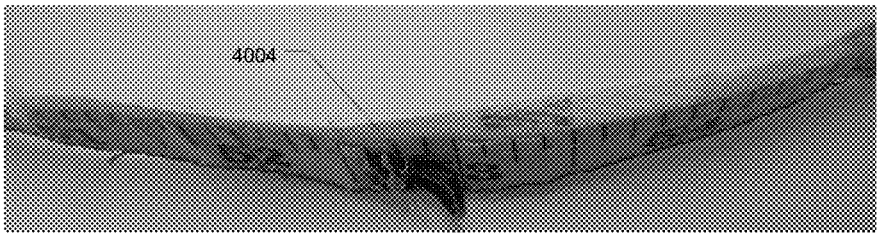
FIG. 40 shows a close-up view of an eye attached to the shape measuring tape.

FIG. 39 shows a close-up view of a shape measuring tape 3904 and an eye 3908 near the 53-inch mark of the shape measuring tape. FIG. 40 shows a close-up view of an eye 4004 attached to the shape measuring tape. In this implementation, a location of the eye is located at approximately 0.89 of the length of the shape measurement tape. In various implementations, a location of the eye is located at approximately less than 06.0, 0.61, 0.70, 0.75, 0.91, or greater than the length of the shape measurement tape. The eye can be located anywhere along the shape measuring tape, before or after the 53-inch mark. For example, the eye can be located at the 51-inch mark. The eye can be located at the 38-inch mark. In another implementation, the eye is positioned between 54 and 55 inches along a length of the measuring tape.

In the figure, the measuring tape is about 59 inches along. This is not intended to limit the invention. The measuring tape can be longer than or shorter than 59 inches. For example, in an implementation, the measuring tape is 52 inches long. In another implementation, the measuring tape is 59.75 inches long. In another implementation, the measuring tape is 63 inches long.

Further, the eye can be attached or connected to the shape measuring tape using a variety of methods. For example, in an implementation, the eye is sewn onto the shape measuring tape. In another implementation, the eye is glued on the second measuring tape. In another implementation, the eye is stitched onto the measuring tape.

Other fasteners or connection techniques may be used to connect the attached measuring tape of the measuring tool to the shape measuring tape. A hook connected to the fabric panel or ruled markings was described as being removably linked to an eye of the shape measuring tape.

In another implementation, the fabric panel has a clasp, clip, button that connects to a fastener of the shape measuring tape. For example, the fastener of the shape measuring tape can be a clasp, clip, button, button-hole, opening.

Further, in another implementation, the fabric panel has at least one eye and the measuring tape at least one hook. In another implementation, the panel has two eyes and the measuring tape has one hook. In another implementation, the panel does not have hooks.

As discussed above, the measuring tapes attached to the measuring tool can be numerically marked such that a user can easily determine where to obtain a circumference measurement of the person's body. The mark can signify to the user to take a measurement from this particular location or distance.

Figure 41:
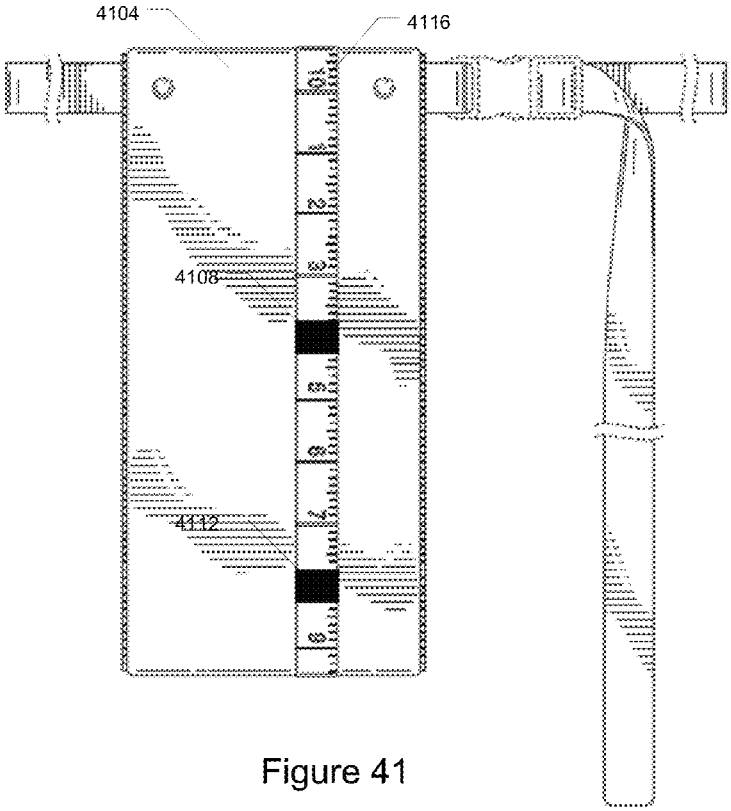
FIG. 41 shows a specific implementation of a measuring tool having a fabric panel with hook-and-loop fasteners.

FIG. 41 shows a specific implementation of a measuring tool having a fabric panel 4104 with hook-and-loop fasteners 4108 at a first distance and 4112 at a second distance along the ruled markings from a reference point 4116. Instead of looking for the first or second distances along the ruled markings, a measurer can feel for the hook-and-loop fasteners.

Figure 42:
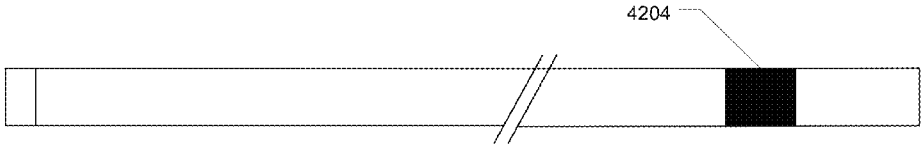
FIG. 42 shows a side of a specific implementation of a shape measuring tape having hook-and-loop fasteners.

FIG. 42 shows a side of a specific implementation of a shape measuring tape 4204 having hook-and-loop fasteners 4204. The measuring tool in FIG. 41 can be used with the shape measuring tape in FIG. 41. Hook-and-loop fasteners 4204 of the shape measuring tape can connect to hook-and-loop fasteners 4108 or 4112 of the measuring tool.

For example, when a user wishes to obtain a measurement at the first distance, the user can press or touch hook-and-loop fastener 4204 of the shape measuring tape to hook-and-loop fastener 4108 of the measuring tool. Hook-and-loop fastener 4204 of the shape measuring tape will easily connect to hook-and-loop fastener 4108 of the measuring tool without the user having to press the shape measuring tape against the.

In an implementation, the hook-and-loop fasteners are Velcro® brand fasteners. Trademarks are the property of their respective owners. Velcro is a registered trademark of Velcro Industries.

Figure 43:
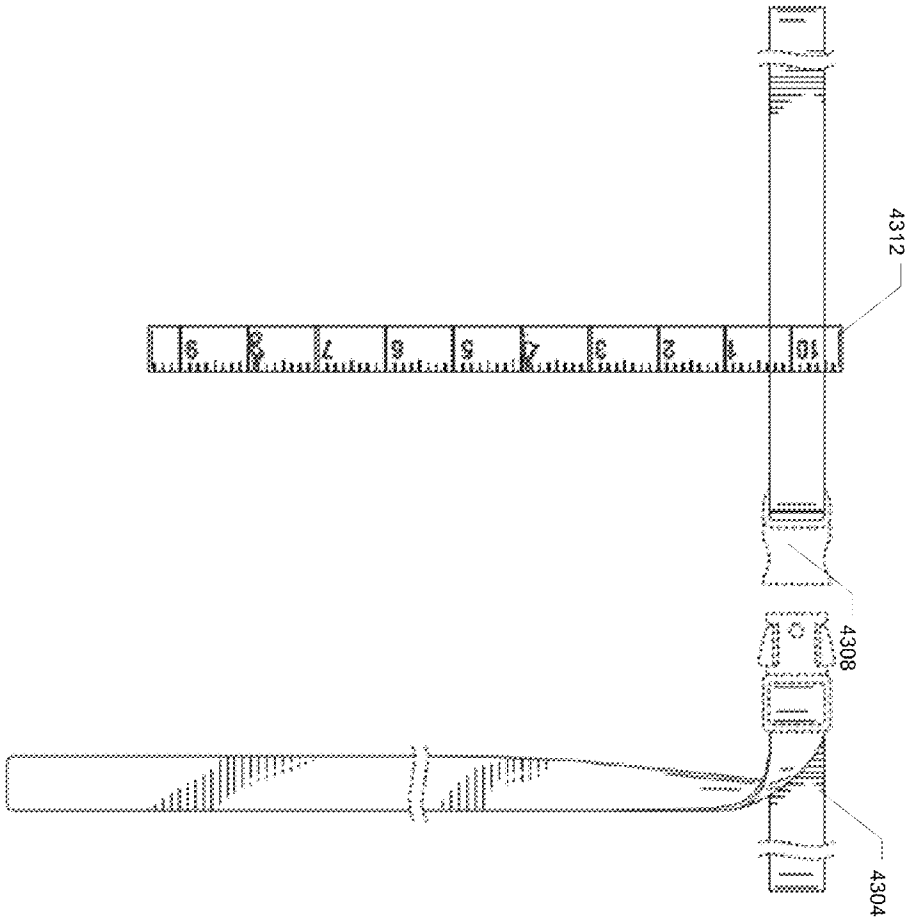
FIG. 43 shows a front view of a specific implementation of a measuring tool having a measuring tape.

FIG. 43 shows a front view of a specific implementation of a measuring tool having a measuring tape. The measuring tool has a belt 4304 and buckle 4308. A measuring tape 4312 is attached to the belt. The attached measuring tape is stuck or bound to the belt using various techniques. For example, using an adhesive, the measuring tape can be attached to the belt. When adhesive is used, the measuring tape is not capable of sliding along the belt. As another example, in various implementations, the measuring tape is attached to the belt using a fastener (e.g., rivet and burr), staples, or pins.

The measuring tape or ruled markings of the measuring tool can have different markings. The markings can be used to signify particular distances or lengths of the measuring tape from a reference point. Further, a measuring tool can have any number of markings (e.g., 0, 1, 2, 3, 4, or more). This may depend on a variety of factors (e.g., number of measurements a user wishes to take). Further, the markings can be any shape as long as it marks the measuring tape at the desired distances.

Figure 44:
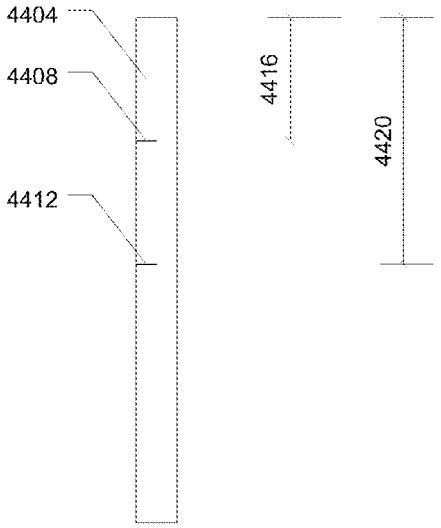
FIG. 44 shows a measuring tape or ruled markings of a measuring tool having two markings.
Figure 45:
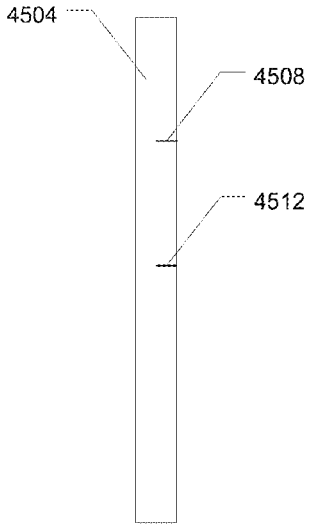
FIG. 45 shows a measuring tape of a measuring tool having markings on a right side of the measuring tape.

FIG. 44 shows a measuring tape or ruled markings 4404 of a measuring tool having two markings The measuring tape has markings 4408 and 4412. Marking 4408 is at a first distance 4416 from a reference point. Marking 4412 is at a second distance 4420 from a reference point. FIG. 45 shows a measuring tape 4504 of a measuring tool having markings 4508 and 4512 on a right side of the measuring tape.

Figure 46:
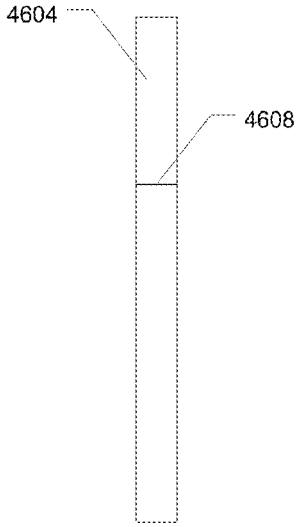
FIG. 46 shows a measuring tape of a measuring tool having one marking.

FIG. 46 shows a measuring tape 4604 of a measuring tool having one marking. A marking 4608 is from a left side to a right side of the measuring tape. If a measurer desires to take a measurement not at marking 4608, the measurer can examine the measuring tape to find another distance. For example, if another measurement is to be taken an inch below marking 4608, the measurer can measure (e.g., with another measuring tape) an inch below marking 4608 and take a measurement at this distance. If measuring tape 4608 is numerically marked (not shown), the user can find the particular distance needed.

Figure 47:
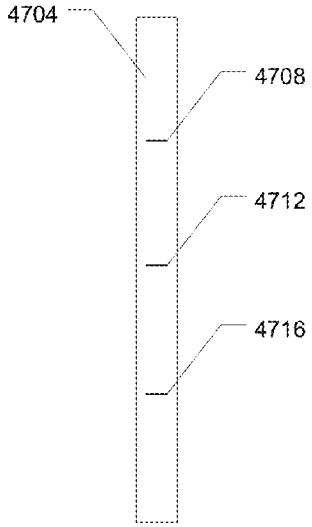
FIG. 47 shows a measuring tape of a measuring tool having three markings.

FIG. 47 shows a measuring tape 4704 of a measuring tool having three markings. Markings 4708, 4712, and 4716 are located at a center of the measuring tape. The markings are located at same x-axis positions and different y-axis positions.

Figure 48:
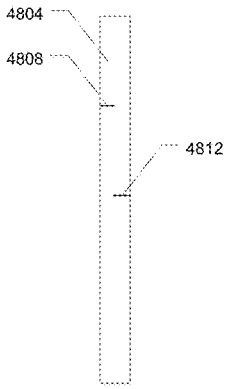
FIG. 48 shows a measuring tape of a measuring tool having a first marking located on a left side of the measuring tape and a second marking located on a right side of the measuring tape.

FIG. 48 shows a measuring tape 4804 of a measuring tool having a first marking 4808 located on a left side of the measuring tape and a second marking 4812 located on a right side of the measuring tape. The first and second markings are located at different positions of an x-axis.

Figure 49:
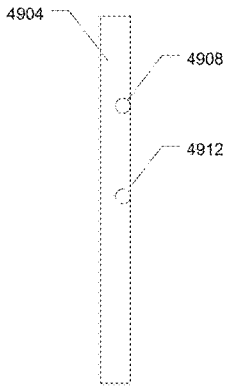
FIG. 49 shows a measuring tape of a measuring tool having circular-shaped markings.
Figure 50:
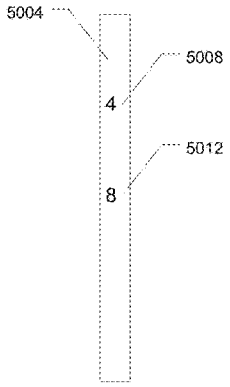
FIG. 50 shows a measuring tape of a measuring tool having numerical markings.
Figure 51:
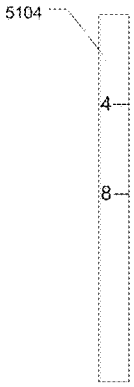
FIG. 51 shows a measuring tape of a measuring tool having numerical markings and line markings.

FIG. 49 shows a measuring tape 4904 of a measuring tool having circular-shaped markings 4908 and 4912. FIG. 50 shows a measuring tape 5004 of a measuring tool having numerical markings 5008 and 5012. First marking 5008 is about 4 inches from a reference point and second marking 5012 is about 8 inches from the reference point. The second marking is about 4 inches below the first marking. FIG. 51 shows a measuring tape 5104 of a measuring tool having numerical markings and line markings The markings can also be in reference to a reference point.

The measuring tape of the measuring tool can also arranged to have a tactile feel at particular distance along the measuring tape such that it is unnecessary for a user to look for markings to determine where a first distance is. At a first distance of the measuring tape, the marking can have a different tactile feel compared to at a second distance of the measuring tape. In an implementation, a first material is at the first distance and protrudes above a surface of the measuring tape, and a second material is at the second distance. The first material is different from the second material.

Figure 52:
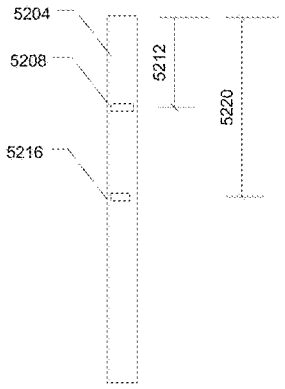
FIG. 52 shows a measuring tape or portion of a fabric panel having two openings.

FIG. 52 shows a measuring tape or portion of a fabric panel 5404 having two openings. The openings are used as markers to signify distances from a reference point. A first opening 5208 is at a first distance 5212, and a second opening 5216 is at a second distance 5220. A user can determine a location of the first or second distances by touching a side of the measuring tape and feeling for the openings in the measuring tape. For example, a user can run her fingers down the measuring tape to feel for the first opening. When the user feels the first opening, the user can obtain a measurement at that distance.

Figure 53:
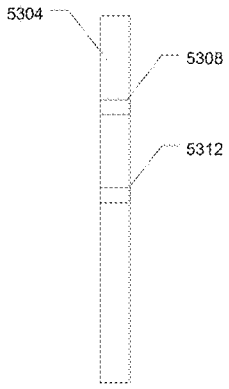
FIG. 53 shows a measuring tape 504 of a measuring tool having first material at a first distance and second material at a second distance of a reference point.

FIG. 53 shows a measuring tape 5304 of a measuring tool having first material 5308 at a first distance and second material 5312 at a second distance of a reference point. The material can be flush with the measuring tape or can protrude above a surface of the measuring tape. The first and second material can be the same from each other or different.

Figure 54:
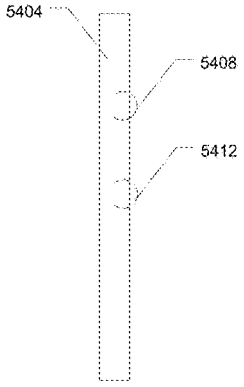
FIG. 54 shows a measuring tape of a measuring tool with clasps.
Figure 55:
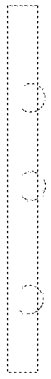
FIG. 55 shows a measuring tape of a measuring tool having three clasps.

FIG. 54 shows a measuring tape 5404 of a measuring tool with a clasp or clip 5408 at a first distance, and a clasp or clip 5412 at a second distance of the measuring tape. FIG. 55 shows a measuring tape of a measuring tool having three clasps.

The measuring tool kit can have a variety of components. For example, in an implementation, the measuring tool kit includes a measuring tool and a measuring tape. In other implementations, however, the kit can include more or less components. For example, in an implementation, a kit contains two measuring tools and a measuring tape. In another implementation, a measuring tool kit includes a measuring tool, a measuring tape, and two indicator clips.

Figure 56A:
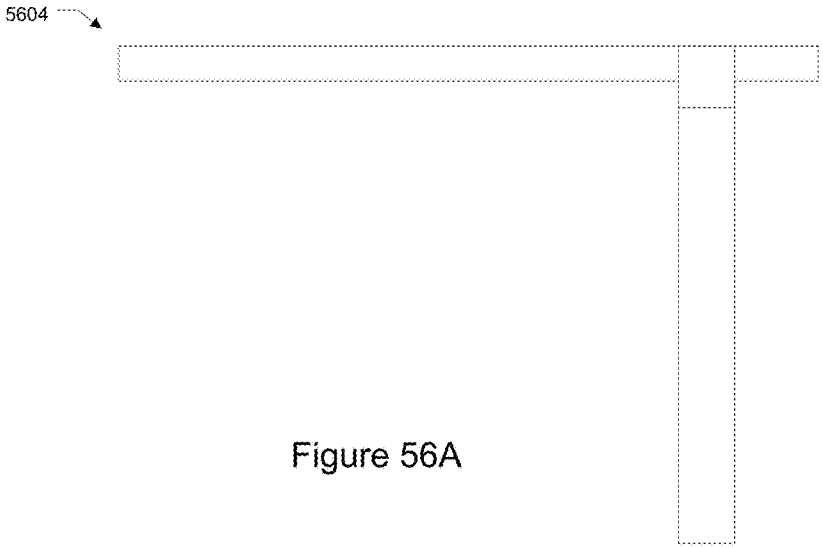
FIGS. 56A-56B show a specific implementation of a measuring tool kit including a measuring tool, a shape measuring tape, and a string to keep the shape measuring tape in a folded position.
Figure 56B:
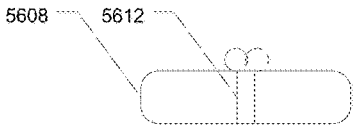

FIGS. 56A-56B show a specific implementation of a measuring tool kit including a measuring tool 5604, a shape measuring tape 5608, and a string 5612 to keep shape measuring tape 5608 in a folded or organized position. FIG. 56A shows a specific implementation of the measuring tool. FIG. 56B shows a specific implementation of the shape measuring tape and string. The string can be tied around shape measuring tape 5608.

Figure 57A:
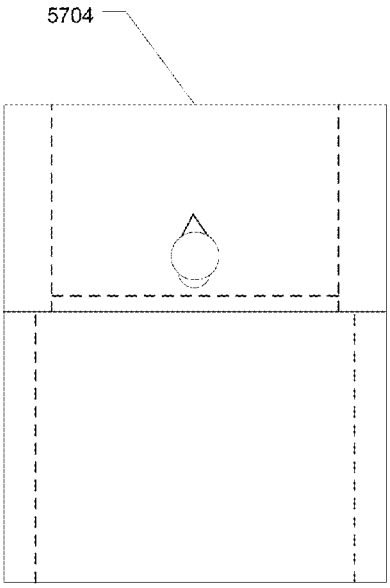
FIGS. 57A-57D show another specific implementation of a measuring tool kit including a bag, a measuring tool, a shape measuring tape, and a user manual.
Figure 57B:
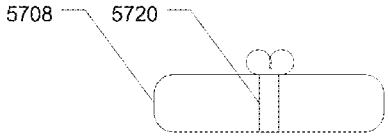
Figure 57C:
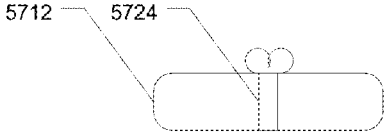
Figure 57D:
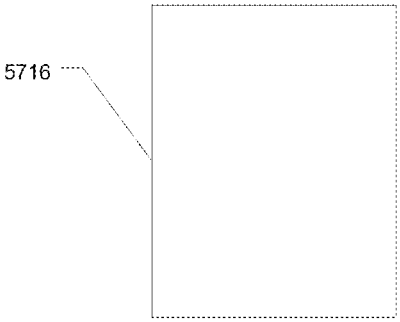

FIGS. 57A-57D show another specific implementation of a measuring tool kit. The kit includes a bag or pouch 5704, a measuring tool 5708, a shape measuring tape 5712, and a user manual 5716. FIG. 57A shows a specific implementation of the bag. FIG. 57B shows a specific implementation of the shape measuring tool. FIG. 57C shows a specific implementation of the shape measuring tape. FIG. 57D shows a specific implementation of the user manual. In FIG. 57A, the bag (shown closed) can be used to store components or items of the kit. In FIG. 57B, a string 5720 is included that ties around the measuring tool. In FIG. 57C, a string 5724 is included that ties around the shape measuring tape.

Figure 58:
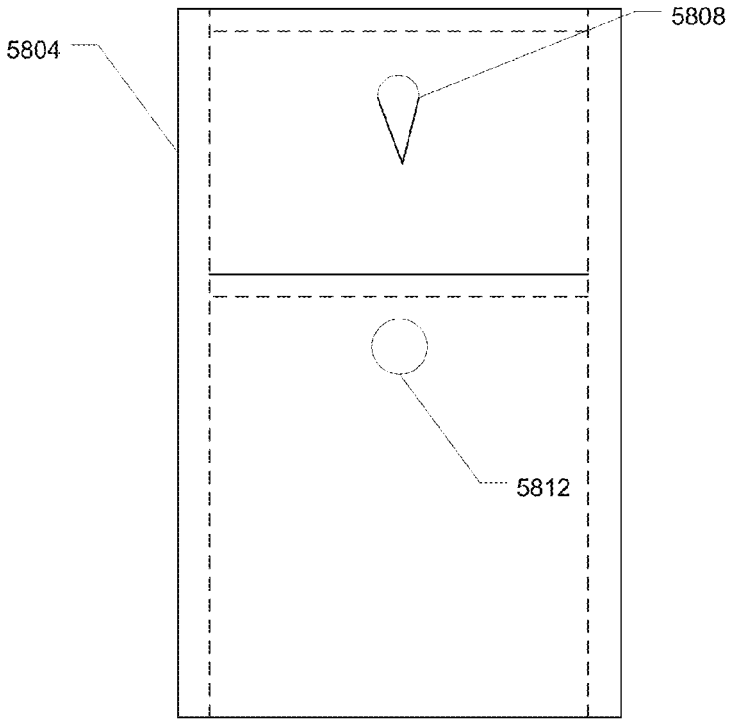
FIG. 58 shows an open bag.

FIG. 58 shows a bag 5804, opened. To close the bag, an opening 5808 on a first portion of the bag is pulled in a direction towards a button 5812 on a second portion of the bag. The button can be slid through the opening.

Figure 59:
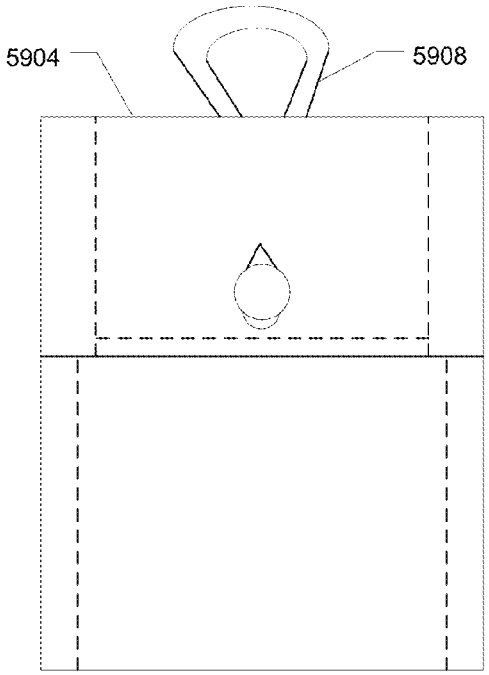
FIG. 59 shows a front view of a bag having a carabiner, where the bag is closed.
Figure 60:
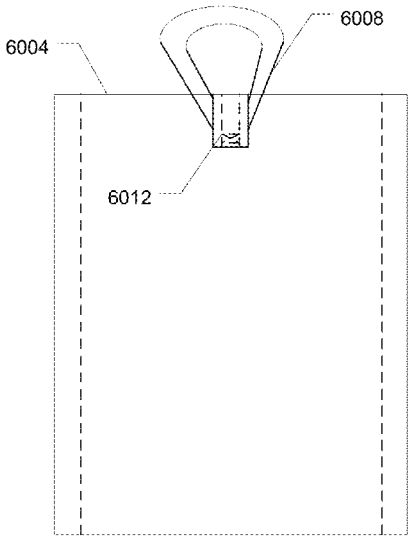
FIG. 60 shows a back view of a bag having a carabiner through a loop, where the bag is closed.
Figure 61:
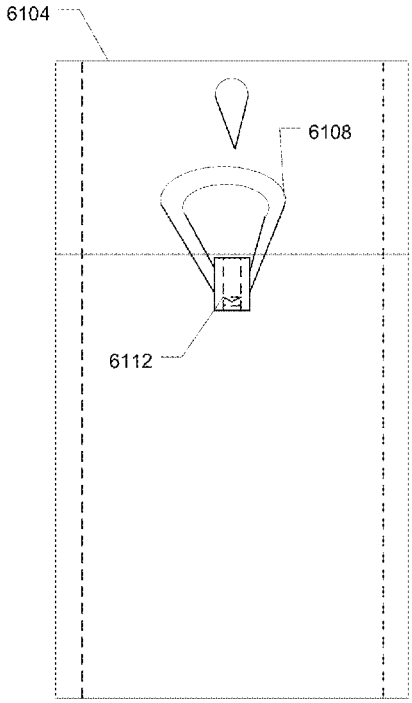
FIG. 61 shows a back view of a bag having a carabiner through a loop, where the bag is opened.

FIG. 59-61 show an implementation of a bag having a carabiner attached to a loop. FIG. 59 shows a front view of a bag 5904 having a carabiner 5908. The bag is closed. FIG. 60 shows a back view of a bag 6004 having a carabiner 6007 through a loop 6012. The bag is closed. FIG. 61 shows a back view of a bag 6104 having a carabiner 6108 through a loop 6112. The bag is opened.

A user can connect the carabiner to her belt buckle so she can be hands-free and measure without worrying about the location of the bag. In an implementation, the carabiner has a sprung gate. In another implementation, the carabiner has a screwed gate. Further, the carabiner can be a variety of shapes such as an oval, a D-shape, an offset-D shape, or a pear. In another implementation, a string is put through the loop and a user ties the bag around her neck.

A bag has been described as housing components of the measuring tool kit. This is not intended to limit the invention. For example, another item may be used to hold items of the measuring tool kit.

Figure 62:
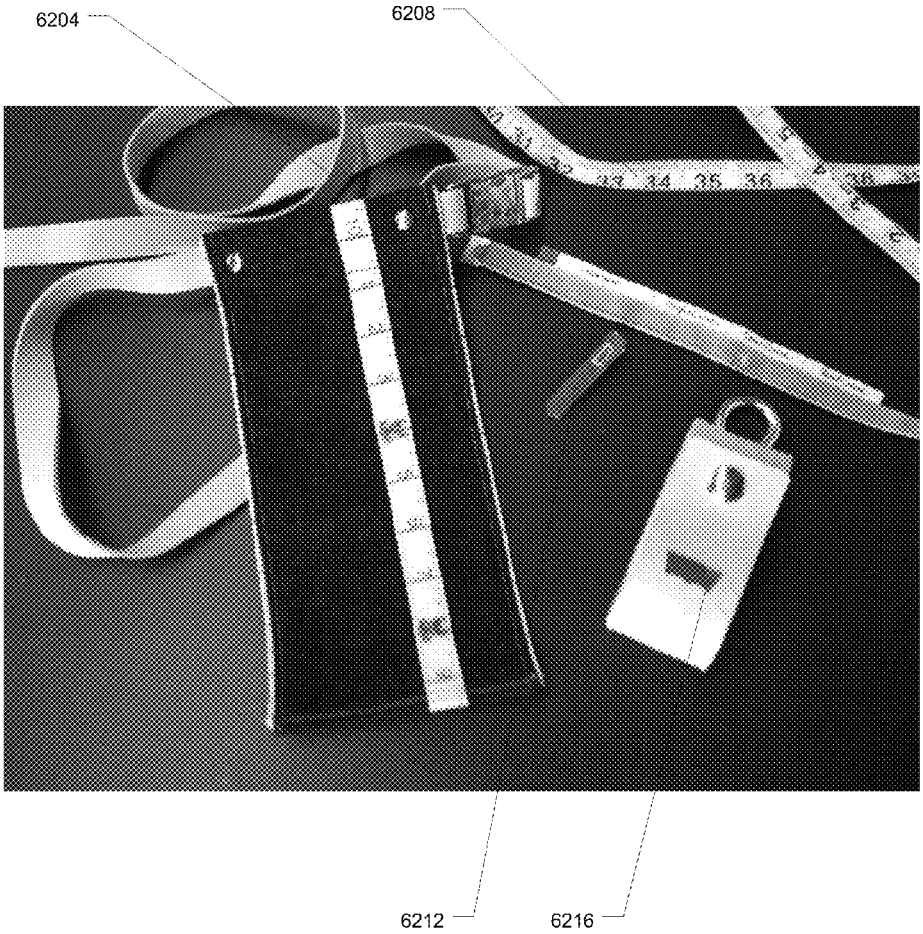
FIG. 62 shows a specific implementation of a measuring tool kit including a measuring tool, a shape measuring tape, a calibration marker, and a leather strap.
Figure 63:
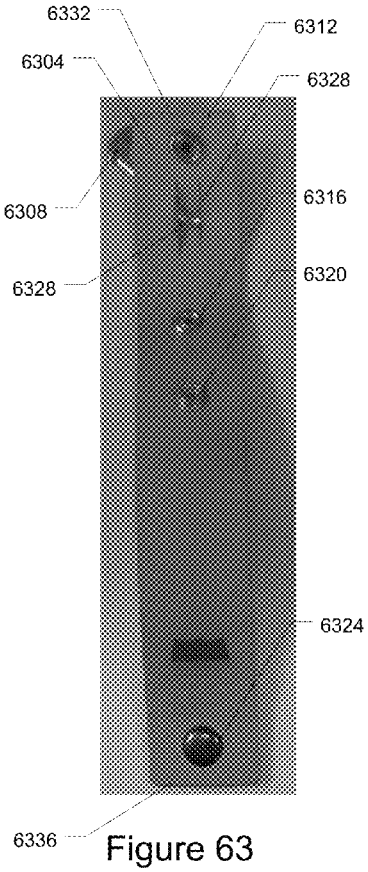
FIG. 63 shows a front view of a leather strap.

FIG. 62 shows a specific implementation of a measuring tool kit. The measuring tool kit includes a measuring tool 6204, a shape measuring tape 6208, a calibration marker 6212, and a holder or leather strap 6216. FIG. 63 shows a front view of the leather strap. The leather strap is open and has a material 6304, a hook or carabiner 6308, and buttons or snap-buttons 6312, 6316, 6320, and 6324. In an implementation, button 6312 connects or snaps onto button 6320.

The carabiner is inserted through slits 6328 of the leather strap. In an implementation, slits 6328 are about ⅜ inch from each other.

In an implementation, the buttons have a diameter of approximately 1 inch. In an implementation, a shortest distance from button 6312 to a side 6332 is about ¼ inch, a shortest distance between buttons 6312 and 6316 is about 1.625 inches, a shortest distance between buttons 6316 and 6320 is about ¾ inch, a shortest distance between buttons 6320 and 6324 is about 5 inches, and a shortest distance between button 6324 and a side 6336 is about ¼ inch. Other implementations may vary in distances between buttons and distances from a button and a side.

Figure 64:
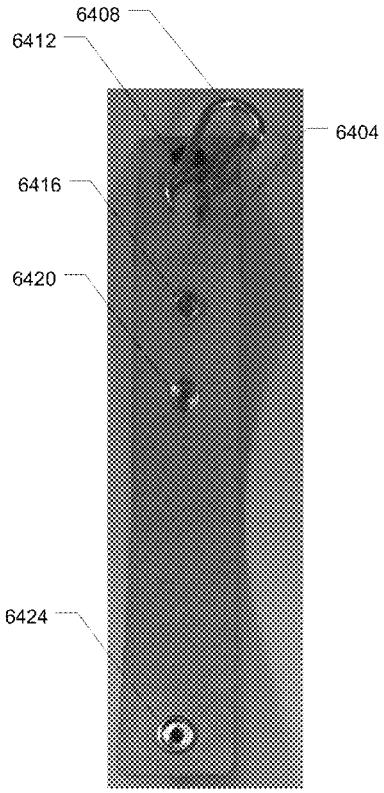
FIG. 64 shows a back view of the leather strap.
Figure 65:
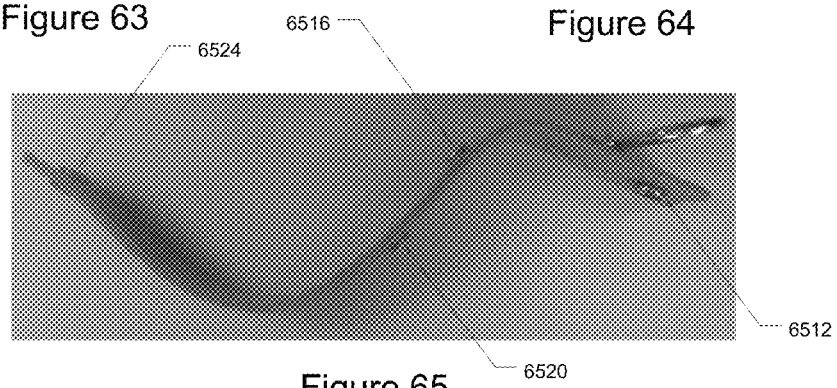
FIG. 65 shows a side view of the leather strap, where the leather strap is open.
Figure 66:
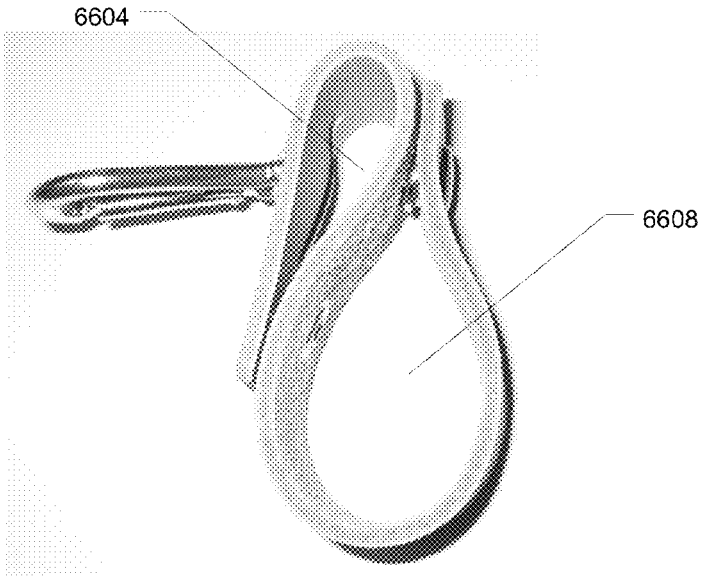
FIG. 66 shows a side view of the closed leather strap, where snap-buttons of the leather strap are snapped together.
Figure 67:
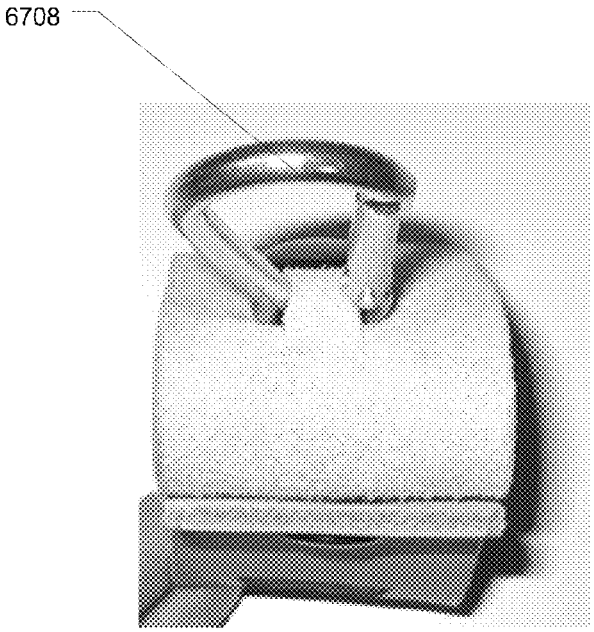
FIG. 67 shows a top side view of a closed leather strap.

FIG. 64 shows a back view of the leather strap. The leather strap is open and has a material 6404, a hook or carabiner 6408, and buttons 6412, 6416, 6420, and 6424. In an implementation, buttons 6416 and 6424 snap onto one another. FIG. 65 shows a side view of the leather strap. The leather strap is open. In an implementation, a button 6512 can connect or fasten to a button 6520, and a button 6516 can connect or fasten to a button 6524 (see FIG. 66). FIG. 66 shows a side view of the closed leather strap. When the leather strap is closed, loop 6604 and loop 6608 form. Items of the measuring tool kit can be held in these loops. FIG. 67 shows a top side view of a closed leather strap. A carabiner 6708 of the leather strap can be attached to a pant buckle.

A size of the leather strap can vary. In an implementation, a leather strap has a length of about 11.375 inches and a width of about 1.625 inches. A length of the leather strap can be less than or greater than about 11.375 inches and a width of the leather strap can be less than or greater than about 1.625 inches. For example, in another implementation, a leather strap has a length of about 10 inches and a width of about 2 inches.

Figure 68:
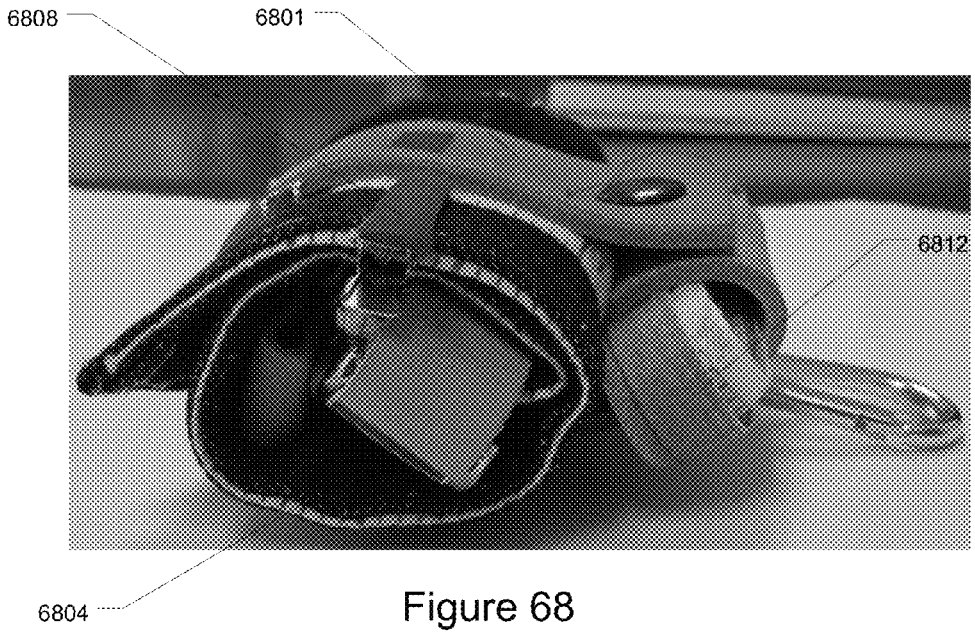
FIG. 68 shows a side view of a leather strap holding items of a measuring tool kit.
Figure 69:
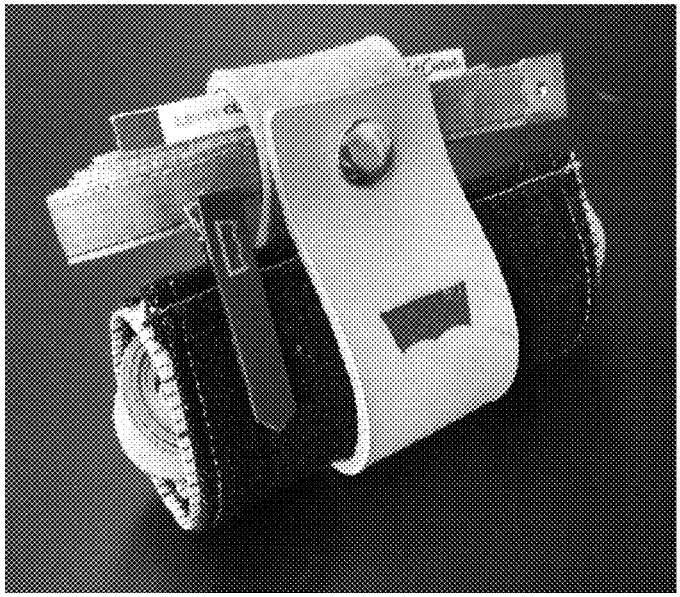
FIG. 69 shows a perspective view of the leather strap storing or holding items of the measuring tool kit.
Figure 70:
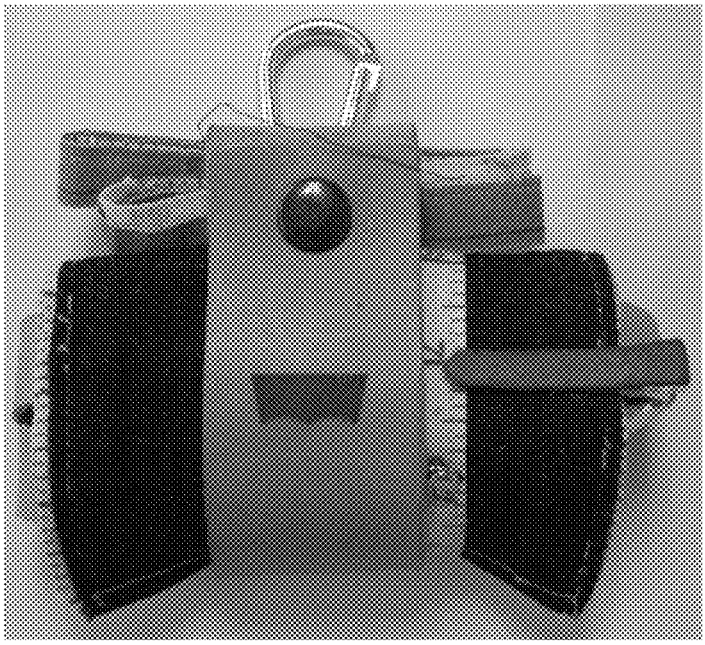
FIG. 70 shows a front view of a leather strap holding items of the measuring tool kit.
Figure 71:
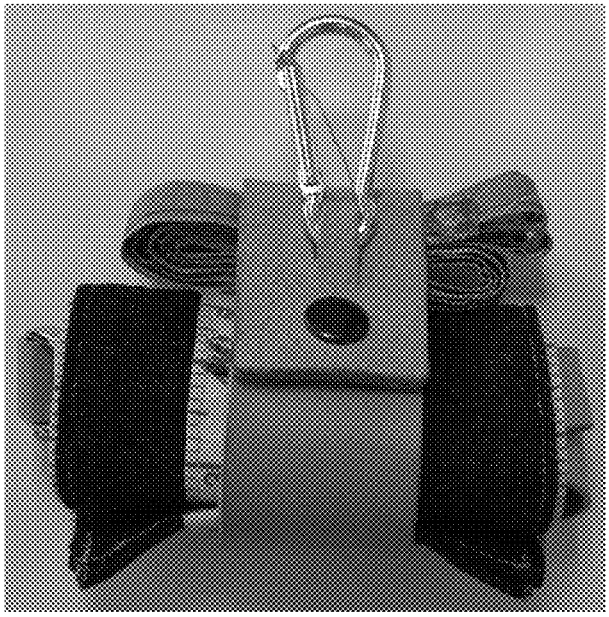
FIG. 71 shows a back view of a leather strap holding items of the measuring tool kit.

FIG. 68 shows a side view of a leather strap 6801 storing or holding items of a measuring tool kit. A measuring tool 6804 is wound up in a first loop of the leather strap. A calibration marker 6808 can be clipped to the measuring tool or shape measuring tape. A shape measuring tape 6812 is wound up in a second loop of the leather strap. FIG. 69 shows a perspective view of the leather strap storing or holding items of the measuring tool kit. FIG. 70 shows a front view of a leather strap storing or holding items of the measuring tool kit. FIG. 71 shows a back view of a leather strap storing or holding items of the measuring tool kit.

Figure 72:
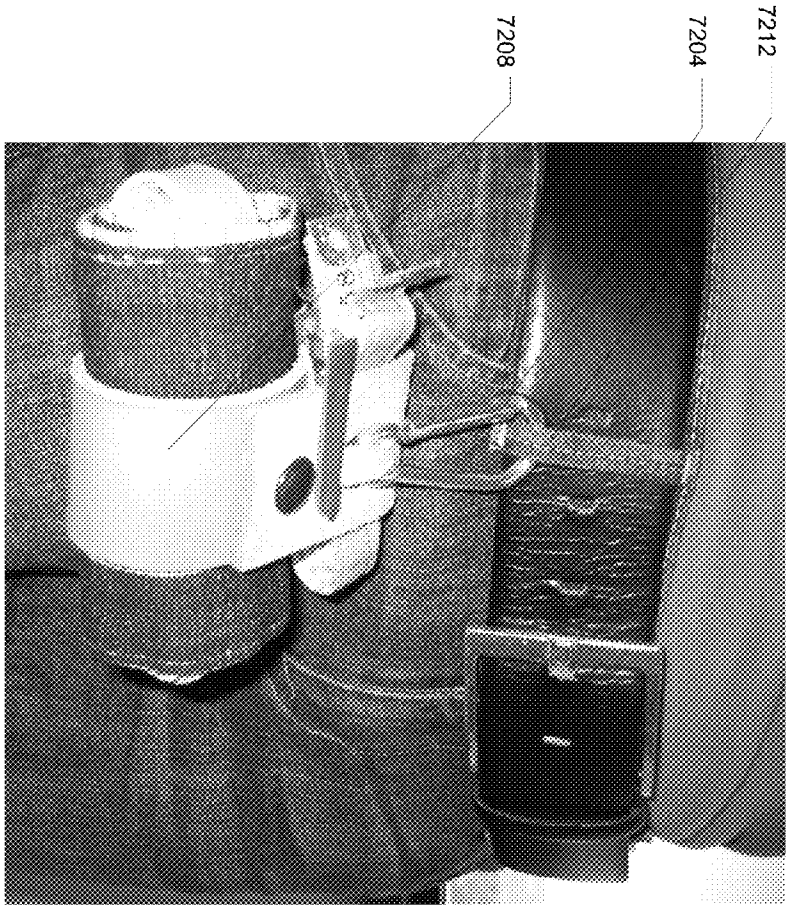
FIG. 72 shows a carabiner of a leather strap linked to a belt loop.

FIG. 72 shows a carabiner 7204 of a leather strap 7208 linked to a belt loop 7212. The strap can be made of a variety of materials. For example, the strap can be made of cloth, plastic, or other materials.

Figure 73:
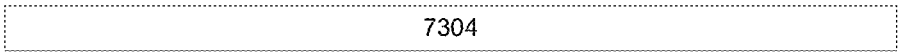
FIGS. 73-75 describe a specific process of making or manufacturing a measuring tool according to a specific embodiment of the invention.
Figure 74:
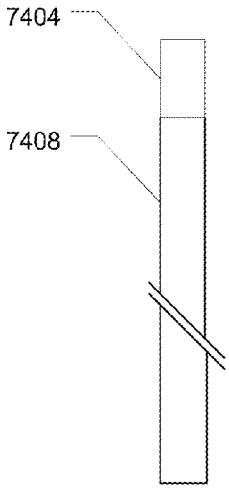
Figure 75:
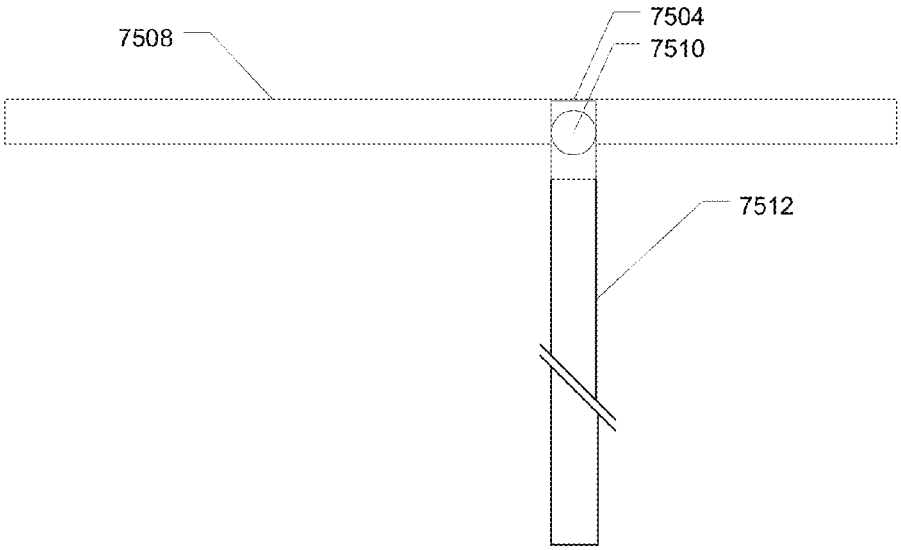

FIGS. 73-75 describe a specific process of making or manufacturing a measuring tool according to a specific embodiment of the invention. Some specific flows and techniques are described in this application, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

In a specific implementation, a technique for making a measuring tool includes:

1. Providing a belt. The belt is a material capable of being bent around arranged securely around a person's waist. As described above, the belt can be a string capable of being tied or a belt. FIG. 73 shows a belt 7304.

2. Wrapping a loop around the belt. The length of the measuring tape can vary. In an implementation, the measuring tape is at least 8 inches. In an implementation, it is not necessary for the measuring tape to touch the ground. In an implementation, the measuring tape is as long as a second distance for a second measurement. In an implementation, the measuring tape is between 8 to 9.5 inches. In an implementation, the measuring tape is between 8.5 to 10 inches. In an implementation, the measuring tape is between 8.25 to 11 inches. In an implementation, the measuring tape is between 8 to 11.5 inches. In an implementation, the measuring tape is between 8 to 12 inches. FIG. 74 shows a loop 7404 and a measuring tape 7408.

3. Attaching the loop to the belt using a fastener. FIG. 75 shows a loop 7504 attached or looped around a belt 7508 via a fastener 7510. When the belt is attached to a person, a measuring tape 7512 is suspended from the fastener. The measuring tape and the belt are at substantially 90 degrees from each other. The measuring tape may be marked so that it is unnecessary for a user to look for particular distances along the measuring tape (e.g., holes).

Figure 76:
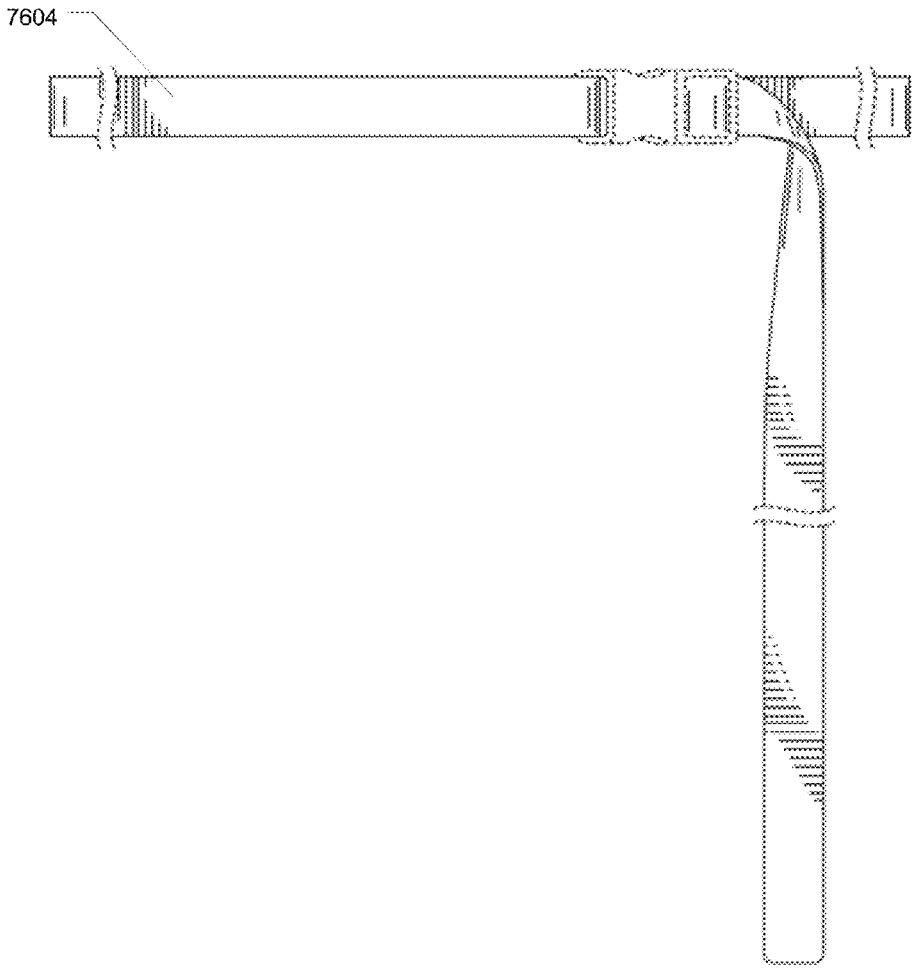
FIGS. 76-78 describe a specific process of making or manufacturing a measuring tool according to a specific embodiment of the invention.
Figure 77:
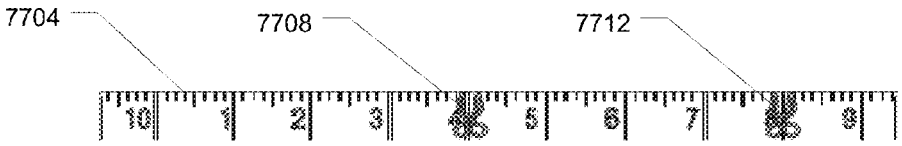
Figure 78:
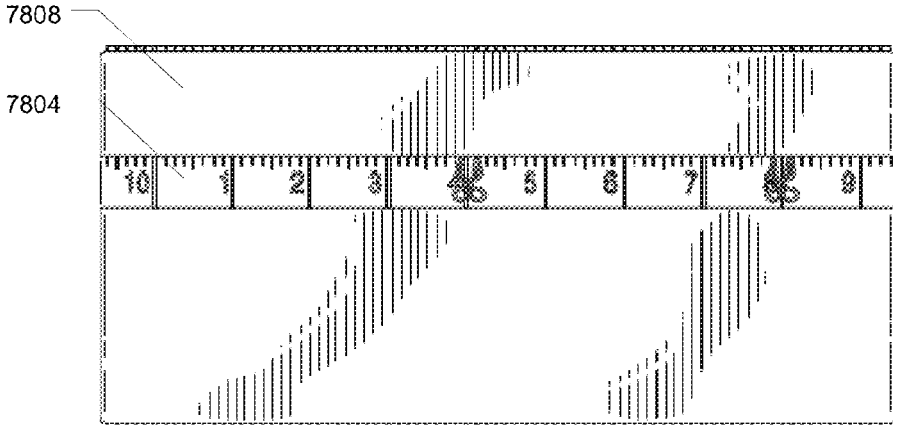

FIGS. 76-78 describe a specific process of making or manufacturing a measuring tool according to a specific embodiment of the invention.

1. Providing a belt. FIG. 76 shows a belt 7604.

2. Adding a clasp to a measuring tape. There are a variety of ways to attach the clasp to the measuring tape. For example, in an implementation, the clasp is sewn onto the measuring tape. In another implementation, the clasp is glued to the measuring tape. In another implementation, the clasp is stitched to the measuring tape. As discussed above, a measuring tape can have other objects or items to signify a particular distance of the measuring tape (e.g., opening, hook-and-loop fastener, or other mark).

FIG. 77 shows a measuring tape 7704 having clasps 7708 and 7712.

3. Joining the measuring tape to a fabric panel. The measuring tape can be attached to the fabric panel in a variety of ways. For example, the measuring tape can be pressed, ironed, glued, stapled, sewn, stitched, or taped to the fabric panel. The fabric panel can be made of any material such as cardboard, jean material, plastic, iron, or any combination. The fabric panel has been described as having a rectangular shape. This is not intended to limit the invention. A shape of the fabric panel can be any shape. For example, the shape of the fabric panel can be an ovular shape.

FIG. 78 shows a measuring tape 7804 joined to a fabric panel 7808.

Figure 79:
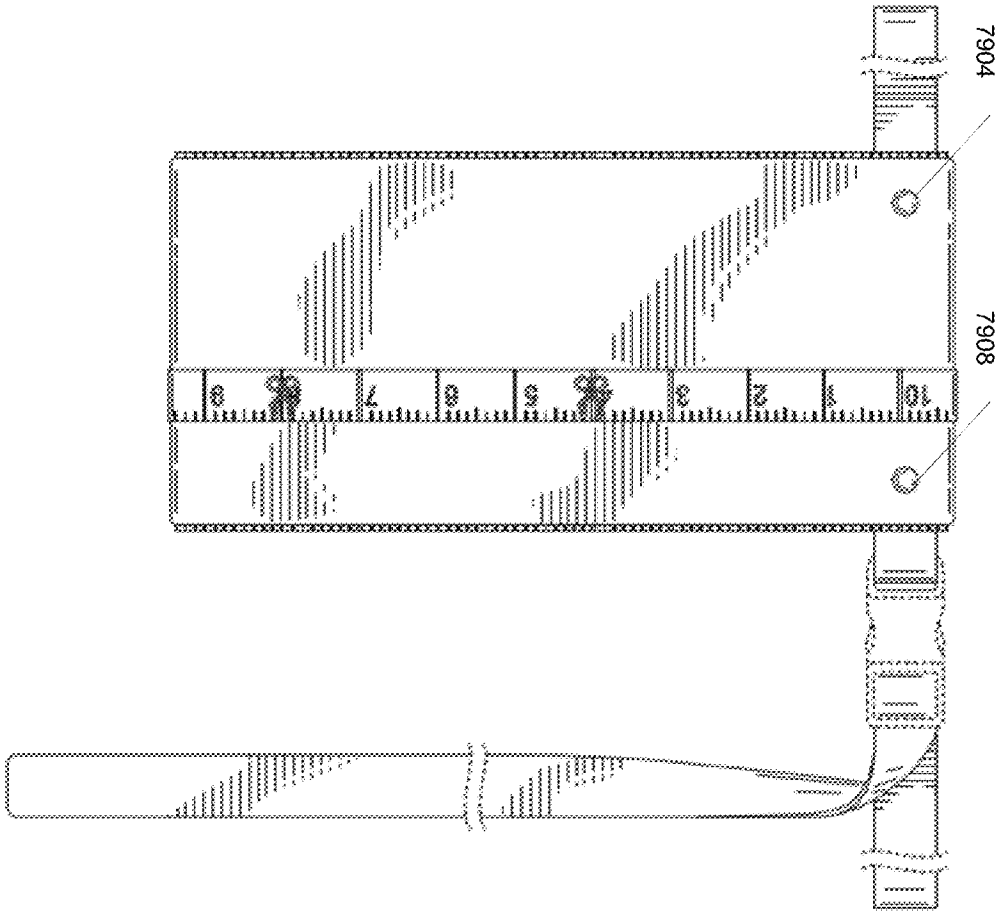
FIG. 79 shows the panel connected to the belt via fasteners.

4. Connecting the fabric panel to the measuring tool. This can be done in a variety of ways such as using big staples, glue, or other means. FIG. 79 shows fasteners 7904 and 7908. These fasteners connect the fabric panel to the belt of the measuring tool.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A measuring device comprising:
a belt, wherein the belt is a string;
a first fastener loop, wrapping around the belt;
a first measuring tape, coupled to the first fastener loop, wherein the first fastener loop allows the first measuring tape to slide along the belt, and the first measuring tape has a length of about 12 inches or less;
a second fastener loop, wrapping around the belt; and
a second measuring tape, coupled to the second fastener loop, wherein the second fastener loop allows the second measuring tape to slide along the belt, and the second measuring tape has a length of about 12 inches or less.

2. The device of claim 1 wherein
the first measuring tape is replaced by a third measuring tape that has a length of 15 inches or less, and the first measuring tape is replaced by a fourth measuring tape that has a length of 15 inches or less.

3. The device of claim 1 wherein the first measuring tape comprises a first side showing measurements in United States customary units.

4. The device of claim 3 wherein the first measuring tape comprises a second side showing measurements in the International System of Units.

5. The device of claim 1 comprising:
a first fastener, coupling the first measuring tape to the first fastener loop,
wherein the loop has a first end coupled to a first side of the first measuring tape by the first fastener, and
a second end coupled to a second side of the first measuring tape by the first fastener.

6. A measuring tool kit comprising:
the measuring device of claim 1; and
a shape measuring tape.

7. A measuring device comprising:
a belt extending in a first direction;
a flexible fabric panel comprising ruled markings, wherein the fabric panel is coupled to the belt and the ruled markings extend in a second direction, and the second direction is transverse to the first direction;
a first fastening member, coupled to the panel at a first predetermined distance from a reference point on the belt in the second direction;
a shape measuring tape comprising ruled markings; and
a second fastening member, coupled to the shape measuring tape, wherein the second fastening member can be removably mated to the first fastening member, thereby removably coupling the shape measuring tape to the flexible fabric panel at the first predetermined distance from the reference point on the belt.

8. The device of claim 7 comprising:

a third fastening member, coupled to the panel at a second distance from a reference point on the belt in the second direction.

9. The device of claim 8 wherein the second fastening member can be removably mated to the third fastening member, thereby removably coupling the shape measuring tape to the flexible fabric panel at the second predetermined distance from the reference point on the belt.

10. The device of claim 8 wherein the second distance is about 8 inches.

11. The device of claim 7 comprising:

a first fastener that punches through the flexible fabric panel and the belt that attaches the flexible fabric panel to the belt.

12. The device of claim 7 comprising:

a first end of a side-release belt buckle, coupled to an end of the belt; and a second end of the side-release belt buckle, comprising a loop through which the belt is fed through, a positioning of the second end on the belt being adjustable via the loop.

13. The device of claim 7 wherein the first distance is about 4 inches.

14. The device of claim 7 wherein the ruled markings comprise United States customary units.

15. The device of claim 7 wherein the ruled markings comprise the International System of Units.

16. The device of claim 7 wherein the reference point is about ⅝ inch from a top side of the belt.

17. A measuring tool kit comprising:

the measuring device of claim 7;

a shape measuring tape; and an indicator clip.

18. The kit of claim 17 comprising:

a leather strap that can hold the measuring device and shape measuring tape.

19. The measuring device of claim 7 wherein the first fastening member comprises a hook.

20. A measuring device comprising:

a belt extending in a first direction, wherein the belt is a string;

a flexible fabric panel comprising ruled markings, wherein the fabric panel is coupled to the belt and the ruled markings extend in a second direction, and the second direction is transverse to the first direction; and a first hook, coupled to the panel at a first distance from a reference point on the belt in the second direction, wherein the first hook points in the first direction.

21. A method of measuring body shape for fitting jeans comprising:

attaching a belt of a measuring tool to a person to be fitted, wherein the tool comprises a flexible panel, coupled to the belt, with ruled markings extending in a direction perpendicular to the belt;

placing a shape measuring tape at a first distance from the belt according to the ruled markings;

extending the shape measuring tape around the person so the shape measuring tape is about parallel with the belt;

using markings on the shape measuring tape, determining a first girth for the person at the first distance from a reference point on the belt;

placing the shape measuring tape at a second distance from the reference point on the belt according to the ruled markings, wherein the second distance is different from the first distance;

extending the shape measuring tape around the person so the shape measuring tape is about parallel with the belt; and using the markings on the shape measuring tape, determining a shape fit category for the person.

22. The method of claim 21 wherein the determining a first girth for the person at the first distance from the belt comprises:

attaching an indicator to a position on the shape measuring tape.

23. The method of claim 21 wherein the ruled markings of the flexible panel are included on a panel measuring tape that is coupled to the flexible panel, and the flexible panel is wider than the panel measuring tape.

24. A method of measuring body shape for fitting jeans comprising:

attaching a belt of a measuring tool to a person to be fitted, wherein the tool comprises a flexible panel, coupled to the belt, with ruled markings extending in a direction perpendicular to the belt;

using the ruled markings as a guide, holding a shape measuring tape at a first distance from the belt;

extending the shape measuring tape around the person so the shape measuring tape is about parallel with the belt;

using markings on the shape measuring tape, determining a first girth for the person at the first distance from a reference point on the belt;

attaching an indicator to a position on the shape measuring tape;

using the ruled markings as a guide, holding a shape measuring tape at a second distance from the reference point on the belt;

extending the shape measuring tape around the person so the shape measuring tape is about parallel with the belt; and using the markings on the shape measuring tape and the attached indicator, determining a jean fit category for the person.

25. The method of claim 24 wherein the second distance is less than the first distance.

26. The method of claim 24 wherein the determining an indicated jean fit category for the person comprises:

reading the jean fit category which the attached indicator points to on the shape measuring tape.

27. The method of claim 24 wherein the belt is a string.

28. The method of claim 24 wherein the flexible panel comprises a first fastening member at the first distance from the belt, and a second fastening at the second distance from the belt, and the shape measuring tape comprises a third fastening member, capable of mating with the first or second fastening members.

29. The method of claim 28 wherein the using the ruled markings as a guide, holding a shape measuring tape at a first distance from the belt comprises:

fastening the third fastening member of the shape measuring tape to the first fastening member of the flexible panel.

30. The method of claim 29 wherein holding a shape measuring tape at a second distance from the reference point on the belt comprises:

fastening the third fastening member of the shape measuring tape to the second fastening member of the flexible panel.

31. The method of claim 24 wherein the ruled markings of the flexible panel are included on a panel measuring tape that is coupled to the flexible panel, and the flexible panel is wider than the panel measuring tape.

32. A measuring device comprising:

a belt extending in a first direction, wherein the belt is a string; and a flexible panel comprising ruled markings, wherein the flexible panel is coupled to the belt and the ruled markings extend in a second direction, and the second direction is transverse to the first direction.

33. The measuring device of claim 32 comprising:

a first fastening member, coupled to the panel at a first distance from a reference point on the belt in the second direction.

34. The measuring device of claim 32 comprising:

a first fastening member, coupled to the panel at a first distance from a reference point on the belt in the second direction; and a second fastening member, coupled to the panel at a second distance from a reference point on the belt in the second direction, wherein the second distance is different from the first distance.

35. The measuring device of claim 32 wherein the flexible panel has a length of about 12 inches or less.

36. The measuring device of claim 32 wherein the ruled markings of the flexible panel are included on a measuring tape that is coupled to the flexible panel, and the flexible panel is wider than the measuring tape.

37. The measuring device of claim 32 wherein the flexible panel comprising ruled markings is a first flexible panel, and the measuring device further comprises:

a second flexible panel comprising ruled markings, wherein the second flexible panel is coupled to the belt and the ruled markings extend in a second direction, and the second direction is transverse to the first direction.

38. A measuring device comprising:

a belt extending in a first direction;

a flexible panel comprising ruled markings, wherein the flexible panel is coupled to the belt and the ruled markings extend in a second direction, and the second direction is transverse to the first direction, and the ruled markings of the flexible panel are included on a measuring tape that is coupled to the flexible panel, and the flexible panel is wider than the measuring tape.

39. The measuring device of claim 38 comprising:

a first fastening member, coupled to the panel at a first distance from a reference point on the belt in the second direction.

40. The measuring device of claim 38 comprising:

a first fastening member, coupled to the panel at a first distance from a reference point on the belt in the second direction; and a second fastening member, coupled to the panel at a second distance from a reference point on the belt in the second direction, wherein the second distance is different from the first distance.

* * * * *